US011462172B2

(12) United States Patent
Park et al.

(10) Patent No.: US 11,462,172 B2
(45) Date of Patent: Oct. 4, 2022

(54) DISPLAY DEVICE AND DRIVING METHOD THEREOF

(71) Applicant: Samsung Display Co., Ltd., Yongin-si (KR)

(72) Inventors: Se Hyuk Park, Yongin-si (KR); Ji Youn Kim, Yongin-si (KR); Hong Soo Kim, Yongin-si (KR); Jin Young Roh, Yongin-si (KR); Hyo Jin Lee, Yongin-si (KR); Jae Keun Lim, Yongin-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 0 days.

(21) Appl. No.: 17/122,505

(22) Filed: Dec. 15, 2020

(65) Prior Publication Data

US 2021/0398490 A1 Dec. 23, 2021

(30) Foreign Application Priority Data

Jun. 23, 2020 (KR) ..... 10-2020-0076705

(51) Int. Cl.
*G09G 3/32* (2016.01)
*G09G 3/3266* (2016.01)

(52) U.S. Cl.
CPC ..... *G09G 3/3266* (2013.01); *G09G 2310/027* (2013.01); *G09G 2310/08* (2013.01); *G09G 2320/0247* (2013.01)

(58) Field of Classification Search
CPC ..... G09G 3/32; G09G 3/3233; G09G 3/3258; G09G 3/3266; G09G 3/3291; G09G 2300/043; G09G 2300/0439; G09G 2300/0809; G09G 2300/0819; G09G 2300/0842; G09G 2300/0861; G09G 2310/0251; G09G 2310/027; G09G 2310/061; G09G 2310/08; G09G 2320/0233; G09G 2320/0247; G09G 2320/043; G09G 2320/045;
(Continued)

(56) References Cited

U.S. PATENT DOCUMENTS 8,803,770 B2 * 8/2014 Jeong ..... G09G 3/3233 345/76
10,885,844 B2 * 1/2021 Koh ..... G09G 3/3258
(Continued)

FOREIGN PATENT DOCUMENTS

KR 10-1152466 6/2012
KR 10-2019-0034375 4/2019

*Primary Examiner* — Michael J Eurice
(74) *Attorney, Agent, or Firm* — Lewis Roca Rothgerber Christie LLP

(57) ABSTRACT

A display device includes: a pixel part including a plurality of pixels; a first scan driver to provide a first scan signal to each of the pixels; and an initialization controller to control the first scan driver. Each of the pixels includes a pixel circuit including a plurality of transistors, and a light emitting element connected to the pixel circuit, an anode of the light emitting element is to be initialized to a first initialization voltage in response to the first scan signal having a gate-on level, and the initialization controller is to determine whether to provide the first scan signal having the gate-on level to each of the pixels for each frame.

20 Claims, 15 Drawing Sheets

(58) Field of Classification Search
CPC ..... G09G 2320/0673; G09G 2330/021; G09G 2340/0435
See application file for complete search history.

(56) References Cited

U.S. PATENT DOCUMENTS

| | | | | |
|---|---|---|---|---|
| 2011/0080395 | A1* | 4/2011 | Chung | G09G 3/3233 345/76 |
| 2012/0001893 | A1* | 1/2012 | Jeong | G09G 3/3233 345/213 |
| 2012/0019499 | A1* | 1/2012 | Hwang | G09G 3/325 345/76 |
| 2012/0306840 | A1* | 12/2012 | Han | G09G 3/3233 345/212 |
| 2014/0035799 | A1* | 2/2014 | Bae | G09G 3/3233 345/82 |
| 2014/0292623 | A1* | 10/2014 | Moon | G09G 3/006 345/82 |
| 2016/0217739 | A1* | 7/2016 | Kang | G09G 3/3233 |
| 2017/0186375 | A1* | 6/2017 | Jung | G09G 3/3233 |
| 2018/0012548 | A1* | 1/2018 | Koh | G09G 3/3258 |
| 2018/0061311 | A1* | 3/2018 | Lin | G09G 3/3291 |
| 2018/0174514 | A1* | 6/2018 | Lee | G09G 3/3233 |
| 2018/0218678 | A1* | 8/2018 | Kwon | G09G 3/3233 |
| 2019/0096330 | A1 | 3/2019 | Kim et al. | |

* cited by examiner

DISPLAY DEVICE AND DRIVING METHOD THEREOF

CROSS-REFERENCE TO RELATED APPLICATION

This application claims priority to and the benefit of Korean Patent Application No. 10-2020-0076705, filed in the Korean Intellectual Property Office on Jun. 23, 2020, the entire content of which is incorporated herein by reference.

BACKGROUND

1. Field

Aspects of one or more example embodiments of the present disclosure relate to a display device and a driving method thereof.

2. Description of the Related Art

As information technology has developed, the importance of a display device, which is a connection medium between a user and information, has been highlighted. Accordingly, usages of display devices, for example, such as a liquid crystal display device and an organic light emitting display device, have been increasing.

Among the display devices, the organic light emitting display device displays an image by using an organic light emitting diode that generates light by recombination of electrons and holes. The organic light emitting display device has a fast response speed, and may be driven with low power consumption.

Recently, a method of driving the organic light emitting display device with multiple frequencies has been used to minimize or reduce power consumption.

The above information disclosed in this Background section is for enhancement of understanding of the background of the present disclosure, and therefore, it may contain information that does not constitute prior art.

SUMMARY

One or more example embodiments of the present disclosure are directed to a display device and a driving method thereof that may minimize or reduce a flicker that may be observed (e.g., that may be viewed) by a user while the display device is driven with a plurality of frequencies.

However, the aspects and features of the present disclosure are not limited to those above, and other aspects and features may be clearly understood to a person of ordinary skill in the art from the following description, or may be learned by practicing one or more example embodiments of the present disclosure.

According to one or more example embodiments of the present disclosure, a display device includes: a pixel part including a plurality of pixels; a first scan driver configured to provide a first scan signal to each of the pixels; and an initialization controller configured to control the first scan driver. Each of the pixels includes a pixel circuit including a plurality of transistors, and a light emitting element connected to the pixel circuit, an anode of the light emitting element is configured to be initialized to a first initialization voltage in response to the first scan signal having a gate-on level, and the initialization controller is configured to determine whether to provide the first scan signal having the gate-on level to each of the pixels for each frame.

In an example embodiment, the initialization controller may include: a frequency determiner configured to determine a frequency for each frame; and a control signal output configured to provide a black voltage control signal to the first scan driver according to the frequency determined by the frequency determiner.

In an example embodiment, the initialization controller may be configured to control the first scan driver to not provide the first scan signal having the gate-on level when there is a change in frequency in a current frame compared to a previous frame.

In an example embodiment, the initialization controller may be configured to control the first scan driver to provide the first scan signal having the gate-on level when there is no change in frequency in the current frame compared to the previous frame.

In an example embodiment, the display device may further include: a timing controller configured to provide a scan driving control signal to the first scan driver.

In an example embodiment, the initialization controller may be implemented as a register in the timing controller.

In an example embodiment, the display device may further include: a power supply configured to provide the first initialization voltage.

In an example embodiment, the power supply may be configured to provide a second initialization voltage to initialize a gate electrode of a driving transistor from among the plurality of transistors.

In an example embodiment, the display device may further include: a second scan driver configured to provide a second scan signal, and the second initialization voltage may be provided to the gate electrode of the driving transistor in response to the second scan signal having a gate-on level.

In an example embodiment, the plurality of transistors may include a P-type transistor and an N-type transistor.

According to one or more example embodiments of the present disclosure, a driving method for driving a display device at a plurality of frequencies, includes: determining a frequency change of a current frame based on a previous frame; and driving the display device in a normal mode or an initialization mode according to a result of the determining of the frequency change. The initialization mode is a mode including a period in the current frame in which an anode of a light emitting element is initialized to an initialization voltage, and the normal mode is a mode that does not include the period in the current frame in which the anode of the light emitting element is initialized.

In an example embodiment, the determining of the frequency change may include: determining whether there is a change in frequency in the current frame based on a frequency of the previous frame, or determining whether a rate of change in frequency between the current frame and the previous frame is greater than or equal to a reference value.

In an example embodiment, the display device may be driven in the initialization mode when there is no change in the frequency of the current frame based on the previous frame, or when the rate of change in frequency is less than the reference value, and the display device may be driven in the normal mode when there is a change in the frequency of the current frame based on the previous frame, or when the rate of change in frequency is greater than or equal to the reference value.

In an example embodiment, the display device may be driven in the normal mode when there is an increase in frequency of the current frame based on the previous frame, or when a rate of change in an increase of frequency of the current frame is greater than or equal to a reference value.

In an example embodiment, the display device may include: a pixel including the light emitting element; a scan driver configured to provide a scan signal to the pixel; and a power supply configured to provide the initialization voltage to the pixel. The initialization voltage may be provided to the anode of the light emitting element in response to the scan signal having a gate-on level.

In an example embodiment, the scan signal may not include the gate-on level in the normal mode, and the scan signal may include the gate-on level in the initialization mode.

In an example embodiment, the driving method may further include: determining whether a luminance in the current frame is less than or equal to a reference value.

In an example embodiment, the determining of the frequency change may be performed when the luminance is less than or equal to the reference value, and the display device may be driven in the initialization mode in the current frame when the luminance is greater than the reference value.

In an example embodiment, the driving method may further include: determining whether a grayscale value in the current frame is less than or equal to a reference value.

In an example embodiment, the determining of the frequency change may be performed when the grayscale value is less than or equal to the reference value, and the display device may be driven in the initialization mode in the current frame when the grayscale value is greater than the reference value.

According to one or more example embodiments of the present disclosure, it may be possible to minimize or reduce a flicker that may be observed (e.g., that may be viewed) by a user while the display device is driven with a plurality of frequencies.

BRIEF DESCRIPTION OF THE DRAWINGS

The above and other aspects and features of the present disclosure will become more apparent to those skilled in the art from the following detailed description of the example embodiments with reference to the accompanying drawings.

DETAILED DESCRIPTION

Figure 1:
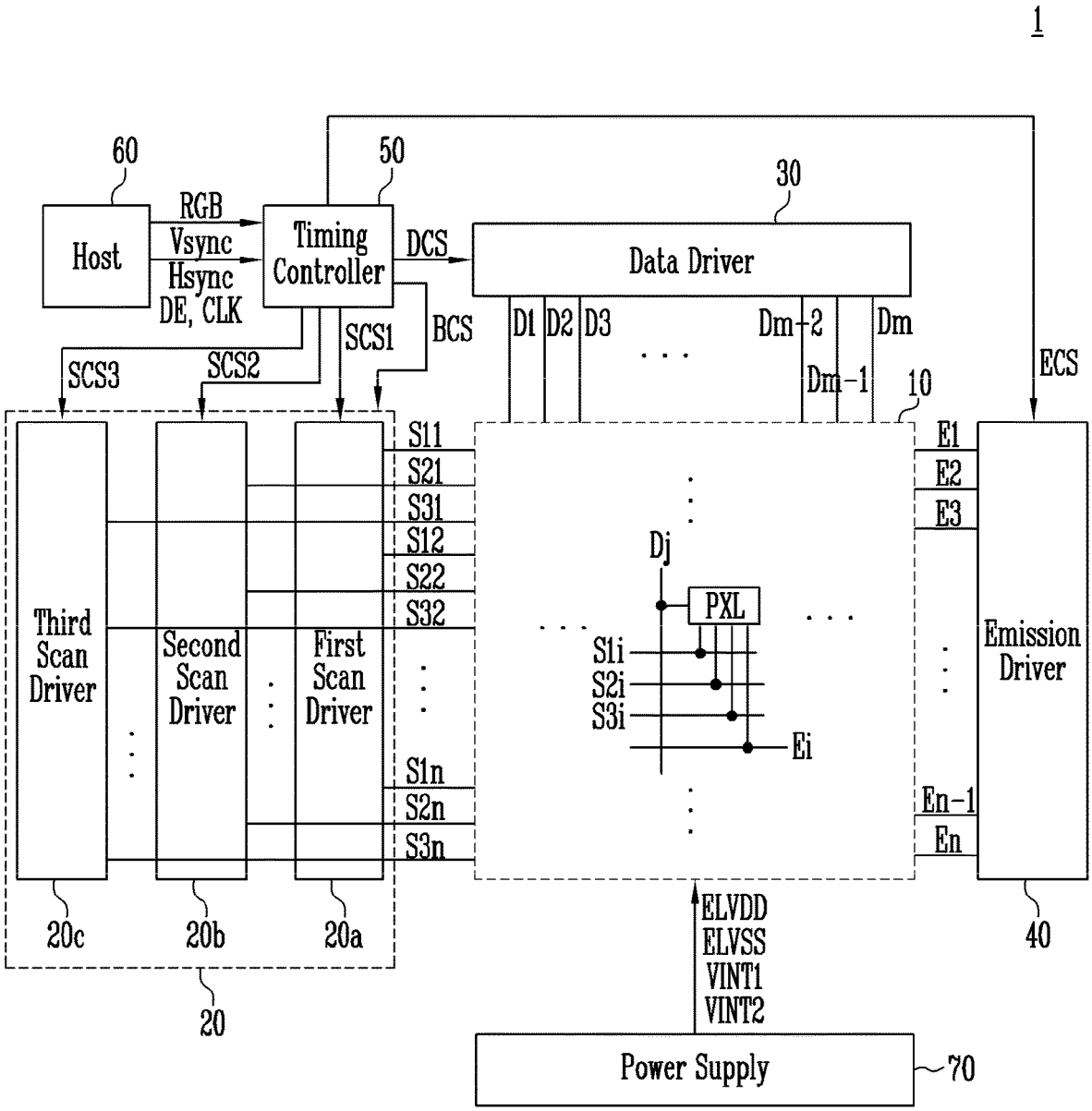
FIG. 1 illustrates a schematic block diagram of a display device according to an embodiment of the present disclosure.

Hereinafter, example embodiments will be described in more detail with reference to the accompanying drawings, in which like reference numbers refer to like elements throughout. The present disclosure, however, may be embodied in various different forms, and should not be construed as being limited to only the illustrated embodiments herein. Rather, these embodiments are provided as examples so that this disclosure will be thorough and complete, and will fully convey the aspects and features of the present disclosure to those skilled in the art. Accordingly, processes, elements, and techniques that are not necessary to those having ordinary skill in the art for a complete understanding of the aspects and features of the present disclosure may not be described. Unless otherwise noted, like reference numerals denote like elements throughout the attached drawings and the written description, and thus, descriptions thereof may not be repeated.

In the drawings, the relative sizes of elements, layers, and regions may be exaggerated and/or simplified for clarity. Spatially relative terms, such as "beneath," "below," "lower," "under," "above," "upper," and the like, may be used herein for ease of explanation to describe one element or feature's relationship to another element(s) or feature(s) as illustrated in the figures. It will be understood that the spatially relative terms are intended to encompass different orientations of the device in use or in operation, in addition to the orientation depicted in the figures. For example, if the device in the figures is turned over, elements described as "below" or "beneath" or "under" other elements or features would then be oriented "above" the other elements or features. Thus, the example terms "below" and "under" can encompass both an orientation of above and below. The device may be otherwise oriented (e.g., rotated 90 degrees or at other orientations) and the spatially relative descriptors used herein should be interpreted accordingly.

It will be understood that, although the terms "first," "second," "third," etc., may be used herein to describe various elements, components, regions, layers and/or sections, these elements, components, regions, layers and/or sections should not be limited by these terms. These terms are used to distinguish one element, component, region, layer or section from another element, component, region, layer or section. Thus, a first element, component, region, layer or section described below could be termed a second element, component, region, layer or section, without departing from the spirit and scope of the present disclosure.

It will be understood that when an element or layer is referred to as being "on," "connected to," or "coupled to" another element or layer, it can be directly on, connected to, or coupled to the other element or layer, or one or more intervening elements or layers may be present. In addition, it will also be understood that when an element or layer is referred to as being "between" two elements or layers, it can be the only element or layer between the two elements or layers, or one or more intervening elements or layers may also be present.

The terminology used herein is for the purpose of describing particular embodiments and is not intended to be limiting of the present disclosure. As used herein, the singular forms "a" and "an" are intended to include the plural forms as well, unless the context clearly indicates otherwise. It will be further understood that the terms "comprises," "comprising," "includes," and "including," "has," "have," and "having," when used in this specification, specify the presence of the stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Expressions such as "at least one of," when preceding a list of elements, modify the entire list of elements and do not modify the individual elements of the list.

As used herein, the term "substantially," "about," and similar terms are used as terms of approximation and not as terms of degree, and are intended to account for the inherent variations in measured or calculated values that would be recognized by those of ordinary skill in the art. Further, the use of "may" when describing embodiments of the present disclosure refers to "one or more embodiments of the present disclosure." As used herein, the terms "use," "using," and "used" may be considered synonymous with the terms "utilize," "utilizing," and "utilized," respectively. Also, the term "exemplary" is intended to refer to an example or illustration.

As used herein, terms such as "more than or equal to" and "greater than or equal to" may be interchangeable with terms such as "more than" or "greater than," and terms such as "smaller than or equal to" or "less than or equal to" may be interchangeable with terms such as "smaller than" or "less than," unless otherwise expressly described, as would be understood by a person having ordinary skill in the arts.

The electronic or electric devices and/or any other relevant devices or components (e.g., timing controller, initialization controller, frequency determiner, and/or the like) according to embodiments of the present disclosure described herein may be implemented utilizing any suitable hardware, firmware (e.g. an application-specific integrated circuit), software, or a combination of software, firmware, and hardware. For example, the various components of these devices may be formed on one integrated circuit (IC) chip or on separate IC chips. Further, the various components of these devices may be implemented on a flexible printed circuit film, a tape carrier package (TCP), a printed circuit board (PCB), or formed on one substrate. Further, the various components of these devices may be a process or thread, running on one or more processors, in one or more computing devices, executing computer program instructions and interacting with other system components for performing the various functionalities described herein. The computer program instructions are stored in a memory which may be implemented in a computing device using a standard memory device, such as, for example, a random access memory (RAM). The computer program instructions may also be stored in other non-transitory computer readable media such as, for example, a CD-ROM, flash drive, or the like. Also, a person of skill in the art should recognize that the functionality of various computing devices may be combined or integrated into a single computing device, or the functionality of a particular computing device may be distributed across one or more other computing devices without departing from the spirit and scope of the exemplary embodiments of the present disclosure.

Unless otherwise defined, all terms (including technical and scientific terms) used herein have the same meaning as commonly understood by one of ordinary skill in the art to which the present disclosure belongs. It will be further understood that terms, such as those defined in commonly used dictionaries, should be interpreted as having a meaning that is consistent with their meaning in the context of the relevant art and/or the present specification, and should not be interpreted in an idealized or overly formal sense, unless expressly so defined herein.

FIG. 1 illustrates a schematic block diagram of a display device according to an embodiment of the present disclosure.

Hereinafter, an organic light emitting display device will be described for convenience as an example of the display device 1. However, the present disclosure is not limited thereto, and the display device 1 may be implemented with any suitable display, for example, such as a liquid crystal display, a micro light emitting diode (LED) display device, a display device including an inorganic light emitting element such as a quantum dot LED, and/or the like. In addition, one or more embodiments of the present disclosure may be applied to a display device including a combination of organic and inorganic materials.

Referring to FIG. 1, in an embodiment, the display device 1 may include a pixel part (e.g., a pixel area or a display area) 10, a scan driver 20, a data driver 30, an emission driver 40, a timing controller 50, and a power supply 70. The display device 1 may be connected to a host 60 to receive various signals and/or data from the host 60.

For example, the host 60 may supply image data RGB to the timing controller 50 through a suitable interface (e.g., a predetermined interface). In addition, the host 60 may supply timing signals Vsync, Hsync, DE, and CLK to the timing controller 50. The host 60 may be implemented in a form of a central processing unit (CPU), a graphics processing unit (GPU), an application processor (AP), and/or the like, but the present disclosure is not limited thereto.

The timing controller 50 may generate scan driving control signals SCS1, SCS2, and SCS3, a data driving control signal DCS, a light emission driving control signal ECS, and a black voltage control signal BCS, according to (e.g., based on) the signals inputted (e.g., received) from the host 60

The scan driving control signals SCS1, SCS2, and SCS3 generated by the timing controller 50 are supplied to the scan driver 20, the data driving control signal DCS is supplied to the data driver 30, and the light emission driving control signal ECS is supplied to the emission driver 40. In addition, the timing controller 50 rearranges the image data RGB supplied from the outside (e.g., from the host 60), and supplies the rearranged image data to the data driver 30. Further, the timing controller 50 supplies the black voltage control signal BCS to at least one of the scan drivers 20 (for example, to a first scan driver 20*a*).

The scan driving control signals SCS1, SCS2, and SCS3 may include at least one clock signal and a start pulse. The start pulse may control an output timing of each scan signal outputted from each of the scan drivers 20. The clock signal may be used to shift the start pulse.

The light emission driving control signal ECS may also include at least one clock signal CLK and a start pulse. The start pulse included in the light emission driving control signal ECS may control an output timing of a light emission control signal outputted from the emission driver 40. The clock signal included in the light emission driving control signal ECS may be used to shift the start pulse.

The data start control signal DCS may include a source start pulse and one or more clock signals. The source start pulse controls a start time of sampling of data, and the clock signals are used to control a sampling operation.

In the embodiment of FIG. 1, the scan driver 20 may include a first scan driver 20*a*, a second scan driver 20*b*, and a third scan driver 20*c*. However, the present disclosure is not limited thereto, and in another embodiment, each of the first scan driver 20*a*, the second scan driver 20*b*, and the third scan driver 20*c* may be provided in a form of a sub-scan driver included in one scan driver.

The first scan driver 20*a* may supply a first scan signal to first scan lines S11 to S1*n* in response to the first scan driving control signal SCS1. Here, n is a natural number greater than one. For example, the first scan driver 20*a* may sequentially supply the first scan signal to the first scan lines S11 to S1*n*. When the first scan signal is sequentially supplied to the first scan lines S11 to S1*n*, pixels PXL may be selected in units of horizontal lines (e.g., in units of rows). In this case, the first scan signal may be set to a gate-on voltage (for example, a low potential (e.g., a low level) voltage), so that a transistor (e.g., a P-type transistor) included in the pixels PXL may be turned on.

The first scan driver 20*a* may provide or may not provide the gate-on voltage (e.g., the first scan signal) to the transistor included in the pixels PXL for each frame in response to the black voltage control signal BCS. In some embodiments, the first scan driver 20*a* may include separate sub-scan drivers for providing the gate-on level voltage to some of the pixels PXL in the same frame, and for not providing the gate-on level voltage to some of the other pixels PXL. In another embodiment, the display device may further include a fourth scan driver for providing the gate-on level voltage to some of the pixels PXL in the same frame, and for not providing the gate-on level voltage to some of the other pixels PXL.

The second scan driver 20*b* may supply a second scan signal to second scan lines S21 to S2*n* in response to the second scan driving control signal SCS2. For example, the second scan driver 20*b* may sequentially supply the second scan signal to the second scan lines S21 to S2*n*. The second scan signal may be set to a gate-on voltage (for example, a high potential (e.g., a high level) voltage), so that a transistor (e.g., an N-type transistor) included in the pixels PXL may be turned on.

The third scan driver 20*c* may supply a third scan signal to third scan lines S31 to S3*n* in response to the third scan driving control signal SCS3. For example, the third scan driver 20*c* may sequentially supply the third scan signal to the third scan lines S31 to S3*n*.

The third scan signal may be set to a gate-on voltage (for example, a high potential (e.g., a high level) voltage), so that a transistor (e.g., an N-type transistor) included in the pixels PXL may be turned on.

Each of the scan drivers 20*a*, 20*b*, and 20*c* may include a plurality of scan stage circuits connected in a form of a shift register. For example, scan signals may be generated by a method of sequentially transmitting a turn-on level pulse (for example, a start pulse) supplied to a scan start line to a next scan stage circuit.

The data driver 30 may supply a data signal to data lines D1 to Dm in response to the data driving control signal DCS. Here, m is a natural number greater than one. The data signal supplied to the data lines D1 to Dm may be supplied to the pixels PXL selected by the first scan signal. In this case, the data driver 30 may supply the data signal to the data lines D1 to Dm to be synchronized or substantially synchronized with the first scan signal.

The emission driver 40 may supply a light emission control signal to light emission control lines E1 to En in response to the light emission driving control signal ECS. For example, the emission driver 40 may sequentially supply the light emission control signal to the light emission control lines E1 to En. When the light emission control signal is sequentially supplied to the light emission control lines E1 to En, the pixels PXL may not emit light in units of horizontal lines (e.g., in units of rows). In this case, the light emission control signal is set to a gate-off voltage (for example, a high potential (e.g., a high level) voltage), so that a transistor (e.g., a P-type transistor) included in the pixels PXL may be turned off.

The power supply 70 may receive an external input voltage, and may provide a power supply voltage to an output terminal by converting the external input voltage. For example, the power supply 70 generates a high power supply voltage ELVDD and a low power supply voltage ELVSS according to (e.g., based on) the external input voltage. As used in the present specification, the high power supply voltage ELVDD and the low power supply voltage ELVSS may be power sources having voltage levels that are relative to each other. For example, the high power supply voltage ELVDD may have a voltage level that is greater than that of the low power supply voltage ELVSS. The power supply 70 may provide a first initialization voltage VINT1 for initializing a gate electrode of a driving transistor T1 (e.g., see FIG. 2) for each pixel PXL, and a second initialization voltage VINT2 for initializing an anode of a light emitting element LD (e.g., see FIG. 2). For example, the first initialization voltage VINT1 and the second initialization voltage VINT2 may have different voltage levels from each other selected from −10 V to 10 V, respectively, but the present disclosure is not limited thereto, and the first and second initialization voltages VINT1 and VINT2 are not limited to the above voltage range.

The power supply 70 may receive an external input voltage from a battery and/or the like, and may boost the external input voltage to generate a power supply voltage that is higher than (e.g., that is greater than) the external input voltage. For example, the power supply 70 may be configured as a power management integrated chip (PMIC). In another example, the power supply 70 may be configured as an external direct current-to-direct current converter integrated circuit (DC/DC IC).

The pixel part 10 includes a plurality of pixels PXL connected to the data lines D1 to Dm, the scan lines S11 to S1*n*, S21 to S2*n*, and S31 to S3*n*, and the light emission control lines E1 to En.

The pixels PXL may receive the initialization power sources VINT1 and VINT2, the high power voltage ELVDD, and the low power voltage ELVSS from the outside.

Each of the pixels PXL may be selected, when a scan signal is supplied to the scan lines S11 to S1*n*, S21 to S2*n*, and S31 to S3*n* connected thereto, to receive a data signal from the data lines D1 to Dm. The pixel PXL receiving the data signal may control an amount of current flowing from the high power voltage ELVDD to the low power voltage ELVSS through the light emitting element LD in response to the data signal.

In the embodiment of FIG. 1, each of the pixels PXL may be a red pixel for emitting red light, a green pixel for emitting green light, or a blue pixel for emitting blue light. However, the present disclosure is not limited thereto, and each of the pixels PXL may be a pixel for emitting various suitable or desired colors of light, for example, such as white light, yellow light, magenta light, and/or cyan light.

Figure 2:
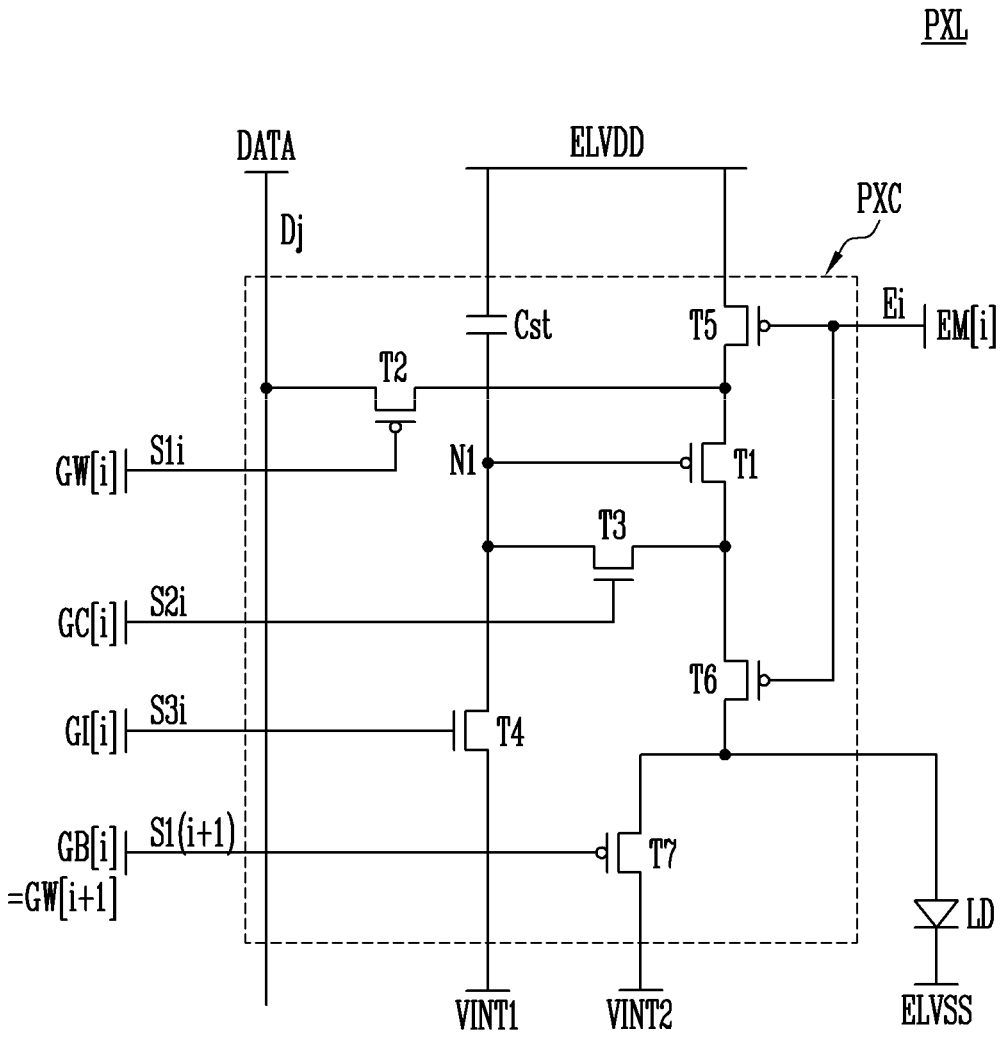
FIG. 2 illustrates a circuit diagram of an example of a pixel illustrated in FIG. 1.

FIG. 2 illustrates a circuit diagram of an example of a pixel illustrated in FIG. 1.

Referring to FIG. 2, the pixel PXL may include the light emitting element LD, and a pixel circuit PXC connected to the light emitting element LD to drive the light emitting element LD. The pixel circuit PXC may include a plurality of transistors T1 to T7, and a storage capacitor Cst. However, the present disclosure is not limited thereto, and the elements included in the pixel circuit PXC of the pixel PXL are not limited to the above.

A first electrode of the first transistor T1 (e.g., the driving transistor) may be connected to the high power voltage ELVDD via the fifth transistor T5, and a second electrode of the first transistor T1 may be connected to an anode of the light emitting element LD via the sixth transistor T6. The first electrode corresponds to one of a source electrode and a drain electrode, and the second electrode corresponds to the other one of the source electrode and the drain electrode. A gate electrode of the first transistor T1 may be connected to a first node N1. The first transistor T1 may control an amount of a current flowing from the high power voltage ELVDD to the low power voltage ELVSS via the light emitting element LD, in response to a voltage of the first node N1.

The second transistor T2 (e.g., a switching transistor) may be connected between a j-th data line Dj and the first electrode of the first transistor T1. A gate electrode of the second transistor T2 may be connected to a first scan line S1*i*. When a first scan signal GW[i] is supplied to the first scan line S1*i*, the second transistor T2 may be turned on to electrically connect the j-th data line Dj to the first electrode of the first transistor T1. Here, i is a natural number greater than or equal to 1 and less than or equal to n, and j is a natural number greater than or equal to 1 and less than or equal to m.

The third transistor T3 (e.g., a diode-connecting transistor) may be connected between the second electrode of the first transistor T1 and the first node N1. In addition, a gate electrode of the third transistor T3 may be connected to a second scan line S2*i*. When a second scan signal GC[i] of the gate-on voltage (for example, the high level voltage) is supplied to the second scan line S2*i*, the third transistor T3 is turned on to electrically connect the second electrode of the first transistor T1 to the first node N1. Accordingly, when the third transistor T3 is turned on, the first transistor T1 may be diode-connected.

The fourth transistor T4 (e.g., a gate initialization transistor) may be connected between the first node N1 and the first initialization power line to which the first initialization voltage VINT1 is applied. In addition, a gate electrode of the fourth transistor T4 may be connected to a third scan line S3*i*. When a third scan signal GI[i] of the gate-on voltage (for example, the high level voltage) is supplied to the third scan line S3*i*, the fourth transistor T4 may be turned on to supply the first initialization voltage VINT1 to the first node N1.

The fifth transistor T5 (e.g., a first light emitting transistor) may be connected between the power supply line to which the high power voltage ELVDD is applied and the first transistor T1. A gate electrode of the fifth transistor T5 may be connected to an i-th light emitting control line Ei. When a light emitting control signal of a gate-off voltage is supplied to the i-th emission control line Ei, the fifth transistor T5 may be turned off, and otherwise (e.g., when a gate-on voltage is supplied), the fifth transistor T5 may be turned on.

The sixth transistor T6 (e.g., a second light emitting transistor) may be connected between the first transistor T1 and the light emitting element LD. A gate electrode of the sixth transistor T6 may be connected to the i-th light emitting control line Ei. When the light emitting control signal (for example, a high level voltage) of the gate-off voltage is supplied to the i-th light emitting control line Ei, the sixth transistor T6 may be turned off, and otherwise (e.g., when a gate-on voltage is supplied), the sixth transistor T6 may be turned on.

The seventh transistor T7 (e.g., an anode initialization transistor) may be connected between a second initialization power line to which the second initialization voltage VINT2 is applied and a first electrode of the light emitting element LD, for example, the anode of the light emitting element LD. In addition, a gate electrode of the seventh transistor T7 may be connected to a first scan line (e.g., a first scan line of a next row) S1(*i*+1) connected to an (i+1)-th pixel (e.g., a pixel of the next row). When a first scan signal (e.g., GW[i−1]; GB[i]) of the gate-on voltage (for example, a low level voltage) is supplied to the first scan line of the next row S1(*i*+1), the seventh transistor T7 may be turned on to supply the second initialization voltage VINT2 to the anode of the light emitting element LD. In some embodiments, the second initialization voltage VINT2 may be set to a voltage lower than that of the data signal. For example, the second initialization voltage VINT2 may be set to a lowest voltage or less of the data signal.

In some embodiments, the first scan signal GW[i] provided to the second transistor T2 may be provided separately from the first scan signal GB[i] provided to the seventh transistor T7. In this case, the first scan signal GW[i] provided to the second transistor T2 and the first scan signal GB[i] provided to the seventh transistor T7 may be provided from separate sub-scan drivers in the first scan driver 20*a*, respectively. In another embodiment, the first scan signal GB[i] provided to the seventh transistor T7 may be provided from the first scan driver 20*a*, and the first scan signal GW[i] provided to the second transistor T2 may be provided from the fourth scan driver described above.

The storage capacitor Cst may be connected between the power line to which the high power voltage ELVDD is applied and the first node N1. The storage capacitor Cst may store a data signal DATA and a voltage corresponding to a threshold voltage of the first transistor T1.

In the embodiment of FIG. 2, some of the plurality of transistors T1 to T7 (for example, T1, T2, T5, T6, and T7) are P-type (PMOS) transistors, and the other remaining transistors (for example, T3 and T4) are N-type (NMOS) transistors.

In another embodiment, respective ones of the transistors T1 to T7 may be P-type (PMOS) transistors. Channels of the transistors T1 to T7 may be made of poly silicon. The poly silicon transistor may be a low temperature poly silicon (LTPS) transistor. The poly silicon transistor has high electron mobility, and thus, has fast driving characteristics.

In another embodiment, the transistors T1 to T7 may be N-type (NMOS) transistors. In this case, channels of the transistors T1 to T7 may be made of an oxide semiconductor. The oxide semiconductor transistor may be processed at a low temperature, and has low charge mobility compared to poly silicon. Therefore, an amount of leakage current occurring in a turn-off state of the oxide semiconductor transistors is smaller than that of the poly silicon transistors.

In the example embodiment of FIG. 2, the light emitting device LD may be an organic light emitting diode. The light emitting element LD may emit light of one of a red color, a green color, or a blue color. However, the present disclosure is not limited thereto.

In the embodiment of FIG. 2, at least one light emitting element LD may be provided for the pixel PXL. For example, the light emitting element LD may be an organic light emitting element, or an inorganic light emitting element such as a micro LED and/or a quantum dot LED. In another example, the light emitting element LD may be a light-emitting element made of a combination of an organic material and an inorganic material.

Figure 3:
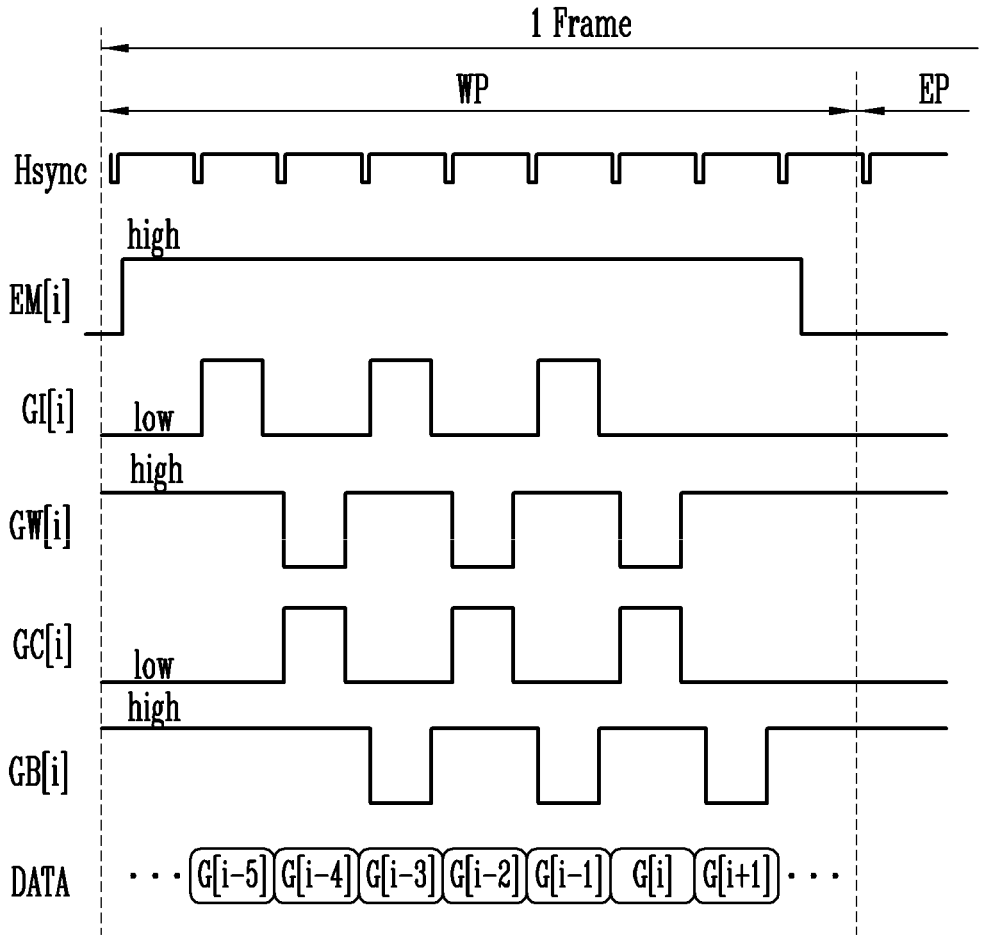
FIG. 3 illustrates an example of a timing diagram for driving the display device of FIG. 1.
Figure 4:
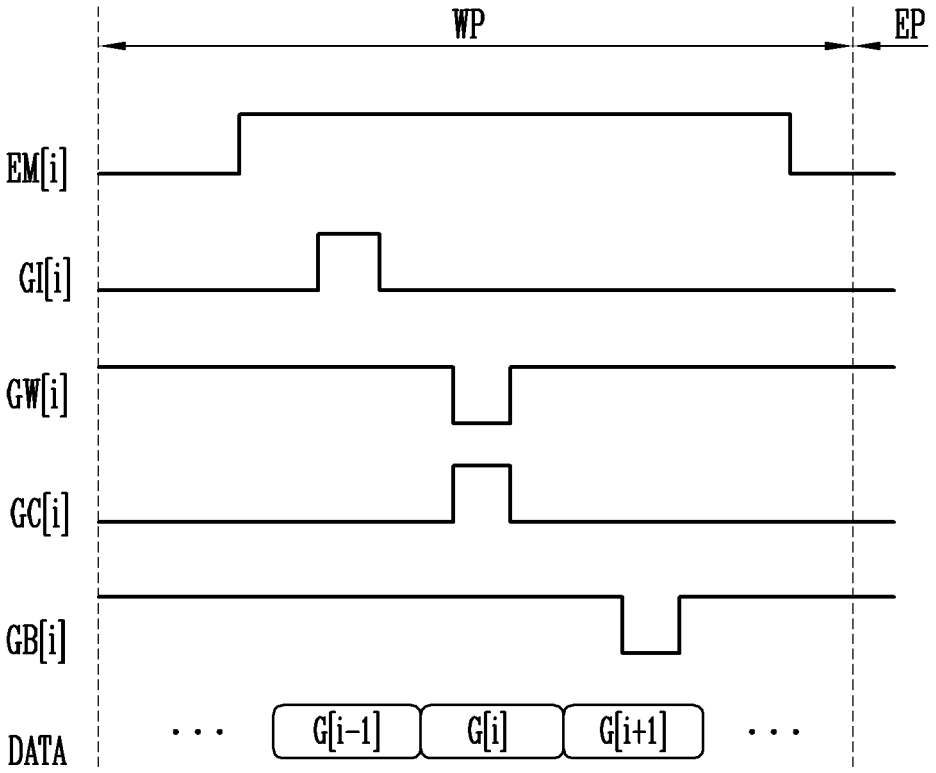
FIG. 4 illustrates an example of a timing diagram for driving the display device of FIG. 1.

FIG. 3 illustrates an example of a timing diagram for driving the display device of FIG. 1. FIG. 4 illustrates an example of a timing diagram for driving the display device of FIG. 1.

Referring to FIG. 1 to FIG. 3, first, a light emission control signal EM[i] of a gate-off voltage (e.g., a high level voltage) may be supplied to the light emission control line Ei during a data writing period WP in one frame (1 Frame). Thus, during the data writing period WP, the fifth and sixth transistors T5 and T6 may be turned off.

A first pulse of the third scan signal GI[i] of a gate-on voltage (e.g., a high level voltage) is supplied to the third scan line S3*i*. Accordingly, the fourth transistor T4 is turned on, and the gate electrode of the first transistor T1 (e.g., the first node N1) is connected to the first initialization power line. Accordingly, a voltage of the gate electrode of the first transistor T1 is initialized to the first initialization voltage VINT1 of the first initialization power line, and is maintained or substantially maintained by the storage capacitor Cst. For example, the first initialization voltage VINT1 of the first initialization power line may be a voltage that is lower (e.g., sufficiently lower) than the high power voltage ELVDD. For example, the first initialization voltage VINT1 may be a voltage having a level that is equal to or substantially equal to (e.g., that is similar to) the low power voltage ELVSS. Accordingly, the first transistor T1 may be turned on.

Next, first pulses of the scan signals GW[i] and GC[i] of the gate-on voltage are supplied to the scan lines S1*i* and S2*i*, respectively, and the corresponding second and third transistors T2 and T3 are turned on. Accordingly, a voltage corresponding to a data signal DATA applied to the data line Dj is written to the storage capacitor Cst through the second, first, and third transistors T2, T1, and T3. However, in this case, the data signal DATA may correspond to a grayscale value G[i−4] of the pixel PXL before 4 horizontal periods, which is not intended for the pixel PXL to emit light, and is instead intended to apply an on-bias voltage to the first transistor T1. When the on-bias voltage is applied to the first transistor T1 before a target data signal DATA is written to the first transistor T1, a hysteresis phenomenon may be ameliorated.

Next, the first pulse of the first scan signal (e.g., of a next row) GB[i] of the gate-on voltage (e.g., a low level voltage) is supplied to the first scan line (e.g., of the next row S1(*i*+1)), and the seventh transistor T7 is turned on. Accordingly, the anode voltage of the light emitting element LD is initialized.

In this case, a second pulse of the third scan signal GI[i] of the gate-on voltage (e.g., a high level voltage) is supplied to the third scan line S3*i*, and the above-described driving process is repeated. In other words, the on-bias voltage is again applied to the first transistor T1, and the anode voltage of the light emitting element LD is again initialized.

By repeating the above-described process, when third pulses of the scan signals GW[i] and GC[i] of the gate-on voltage are supplied to the scan lines S1*i* and S2*i*, respectively, a voltage corresponding to the data signal DATA corresponding to the grayscale value G[i] of the pixel PXL is written to the storage capacitor Cst. In this case, the voltage corresponding to the data signal DATA written to the storage capacitor Cst is a voltage reflecting a decrease in a threshold voltage of the first transistor T1.

Finally, when the light emission control signal EM[i] becomes the gate-on voltage (e.g., a low level voltage), the fifth and sixth transistors T5 and T6 are turned on. Accordingly, a driving current path connected to the high power voltage ELVDD, the fifth, first, and sixth transistors T5, T1, and T6, the light emitting element LD, and the low power voltage ELVSS is formed, and a driving current flows through the driving current path. A driving current amount of the driving current corresponds to the voltage of the data signal DATA stored in the storage capacitor Cst. In this case, because the driving current flows through the first transistor T1, a decrease in the threshold voltage of the first transistor T1 is reflected thereto. Accordingly, because the decrease in the threshold voltage reflected in the voltage of the data signal DATA stored in the storage capacitor Cst and the decrease in the threshold voltage reflected in the driving current cancel each other, the driving current corresponding to the data signal DATA may flow regardless of the threshold voltage value of the first transistor T1. Depending on the amount of driving current, the light emitting element LD emits light at a target luminance during a light emitting period EP.

In the present embodiment of FIG. 3, it has been described that respective scan signals include three pulses, but in some embodiments, the respective scan signals may include two pulses or four or more pulses. In another embodiment, the respective scan signals may be configured to include one pulse, in which case the process of applying the on-bias voltage to the first transistor T1 may be omitted (e.g., see FIG. 4).

In addition, an interval between pulses adjacent to a horizontal synchronization signal Hsync may correspond to one horizontal period. Although the pulse of the horizontal synchronization signal Hsync is shown in FIG. 3 at a low level, the present disclosure is not limited thereto, and the pulse of the horizontal synchronization signal Hsync may correspond to a high level in another embodiment.

In some embodiments, the first scan signal applied to the seventh transistor T7 GB[i] of the gate-on voltage (e.g., the low level voltage) may not be supplied according to (e.g., based on) the black voltage control signal BCS. Accordingly, the seventh transistor T7 may maintain or substantially maintain a turn-off state when the black voltage control signal BCS is supplied, and an anode voltage initialization operation of the light emitting element LD may not be performed. The black voltage control signal BCS may correspond to a signal for determining whether to supply the first scan signal applied to the seventh transistor GB[i]

according to the frequency for each frame. This will be described in more detail below with reference to FIG. 6 to FIG. 8.

For convenience of description, the below description with reference to FIGS. 6-15 assumes the example timing diagram for driving the display device of FIG. 4, in which the respective scan signals include one pulse as shown in FIG. 4, but the present disclosure is not limited thereto.

Figure 5:
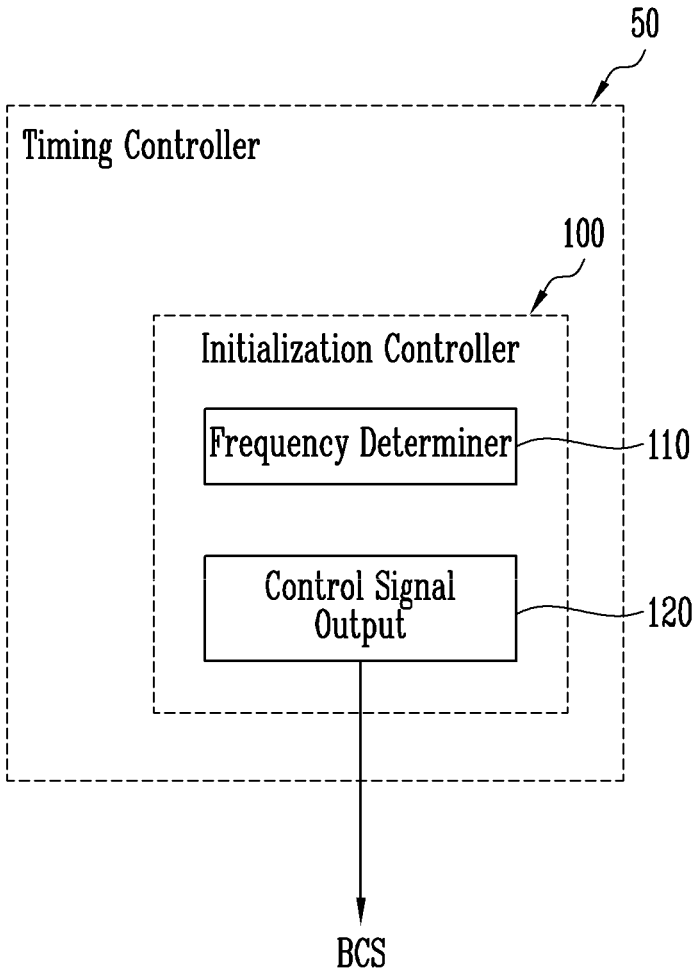
FIG. 5 illustrates a schematic block diagram of the timing controller of FIG. 1.

FIG. 5 illustrates a schematic block diagram of the timing controller of FIG. 1.

Referring to FIG. 5, as an example, the timing controller 50 may include an initialization controller 100.

The initialization controller 100 may include a frequency determiner 110 for determining a frequency for each frame, and a control signal output 120 for outputting the black voltage control signal BCS, which may be a signal for controlling whether to provide the first scan signal (e.g., applied to the seventh transistor T7) of the gate-on level supplied to each pixel by the first scan driver 20*a*.

In the embodiment of FIG. 5, the frequency determiner 110 may determine a frequency of a current frame and a frequency of an immediately preceding frame. For example, the frequency determiner 110 may determine a frequency for each frame by using a method of counting a clock signal, and/or the like. In addition, the frequency determiner 110 may determine the frequency for each frame, and may calculate a time period for each frame based on the determined frequency for each frame. For example, the frequency may be inversely proportional to the time period.

In the embodiment of FIG. 5, the control signal output 120 may provide the black voltage control signal BCS to the first scan driver 20*a*. For example, the black voltage control signal BCS may be a signal that the first scan driver 20*a* uses to determine whether to provide the first scan signal (e.g., applied to the seventh transistor T7) of the gate-on level to each pixel, or may be a signal for blocking the scan driving control signal (e.g., SCS1) provided from the timing controller 50 to the first scan driver 20*a*. In other words, the black voltage control signal BCS may be provided in a variety of suitable forms as needed or desired.

In the embodiment of FIG. 5, when the frequency determiner 110 compares the frequency (e.g., the time period) of the current frame with the frequency (e.g., the time period) of the previous frame, and determines that a rate of change therebetween is greater than or equal to a suitable reference value (e.g., a predetermined reference value), the initialization controller 100 may output the black voltage control signal BCS through the control signal output 120 for controlling the first scan driver 20*a* to not provide the first scan signal (e.g., applied to the seventh transistor T7) of the gate-on level (or in other words, to provide the first scan signal (e.g., applied to the seventh transistor T7) of the gate-off level) to each pixel in the current frame. In addition, when the frequency determiner 110 compares the frequency (e.g., the time period) of the current frame with the frequency (e.g., the time period) of the previous frame, and determines that a rate of change therebetween does not exceed (e.g., is less than or equal to) a suitable reference value (e.g., a predetermined reference value), the initialization controller 100 may output the black voltage control signal BCS through the control signal output 120 for controlling the first scan driver 20*a* to provide the first scan signal (e.g., applied to the seventh transistor T7) of the gate-on level to each pixel in the current frame. Here, the rate of change may be determined based on an absolute value (e.g., of a difference between the frequency (e.g., the time period) of the current frame and the frequency (e.g., the time period) of the previous frame).

In another embodiment, when the frequency determiner 110 compares the frequency (e.g., the time period) of the current frame with the frequency (e.g., the time period) of the previous frame, and determines that there is a change therebetween, the initialization controller 100 may output the black voltage control signal BCS through the control signal output 120 for controlling the first scan driver 20*a* to not provide the first scan signal (e.g., applied to the seventh transistor T7) of the gate-on level (or in other words, to provide the first scan signal (e.g., applied to the seventh transistor T7) of the gate-off level) to each pixel in the current frame. In addition, when the frequency determiner 110 compares the frequency (e.g., the time period) of the current frame with the frequency (e.g., the time period) of the previous frame, and determines that there is no change therebetween, the initialization controller 100 may output the black voltage control signal BCS through the control signal output 120 for controlling the first scan driver 20*a* to provide the first scan signal (e.g., applied to the seventh transistor T7) of the gate-on level to each pixel in the current frame.

The display device 1 may determine a driving mode in the current frame by comparing the frequency (e.g., the time period) of the current frame with the frequency (e.g., the time period) of the previous frame. The display device 1 may select one of a plurality of driving modes in one frame, and may be driven in the selected driving mode. For example, the driving mode may include a normal mode in which the gate-on level is not included in the first scan signal (e.g., applied to the seventh transistor T7) provided to each pixel by the first scan driver 20*a* in the current frame, and an initialization mode in which the gate-on level is included in the first scan signal (e.g., applied to the seventh transistor T7) provided to each pixel by the first scan driver 20*a* in the current frame.

When the display device 1 is driven in the normal mode in the current frame, the second initialization voltage VINT2 may not be provided to the anode of the light emitting element in each pixel (e.g., the anode is not separately initialized in the current frame). When the display device 1 is driven in the initialization mode in the current frame, the second initialization voltage VINT2 is provided to the anode of the light emitting element in each pixel, so that the anode may be initialized to a voltage level corresponding to the second initialization voltage VINT2.

In the embodiment of FIG. 5, the black voltage control signal BCS may be a digital signal. For example, the black voltage control signal BCS may be provided as a signal having a value (e.g., a voltage value) corresponding to a logical low level (e.g., '0') to the first scan driver 20*a*, so that in the normal mode, the first scan driver 20*a* does not provide the first scan signal (e.g., applied to the seventh transistor T7) of the gate-on level to each pixel. On the other hand, the black voltage control signal BCS may be provided as a signal having a value (e.g., a voltage value) corresponding to a logical high level (e.g., '1') to the first scan driver 20*a*, so that in the initialization mode, the first scan driver 20*a* provides the first scan signal (e.g., applied to the seventh transistor T7) of the gate-on level to each pixel. In another embodiment, the black voltage control signal BCS may be provided as a signal having a value (e.g., a voltage value) corresponding to the logical high level (e.g., '1') to the first scan driver 20*a* to be driven in the normal mode in the current frame, and may be provided as a signal having a value (e.g., a voltage value) corresponding to the logical low level (e.g., '0') to the first scan driver 20*a* to be driven in the initialization mode in the current frame.

In some embodiments, the timing controller 50 may include a plurality of registers. In some embodiments, the initialization controller 100 may also be provided in the timing controller 50 in a form of at least one register to determine the frequency of the previous frame. In this case, the initialization controller 100 may receive a signal corresponding to a variable frame from the outside.

Hereinafter, a driving method of the display device according to the present embodiment will be described based on a first frame, a second frame, a third frame, a fourth frame, and a fifth frame, which are continuous arbitrary frames.

Figure 6:
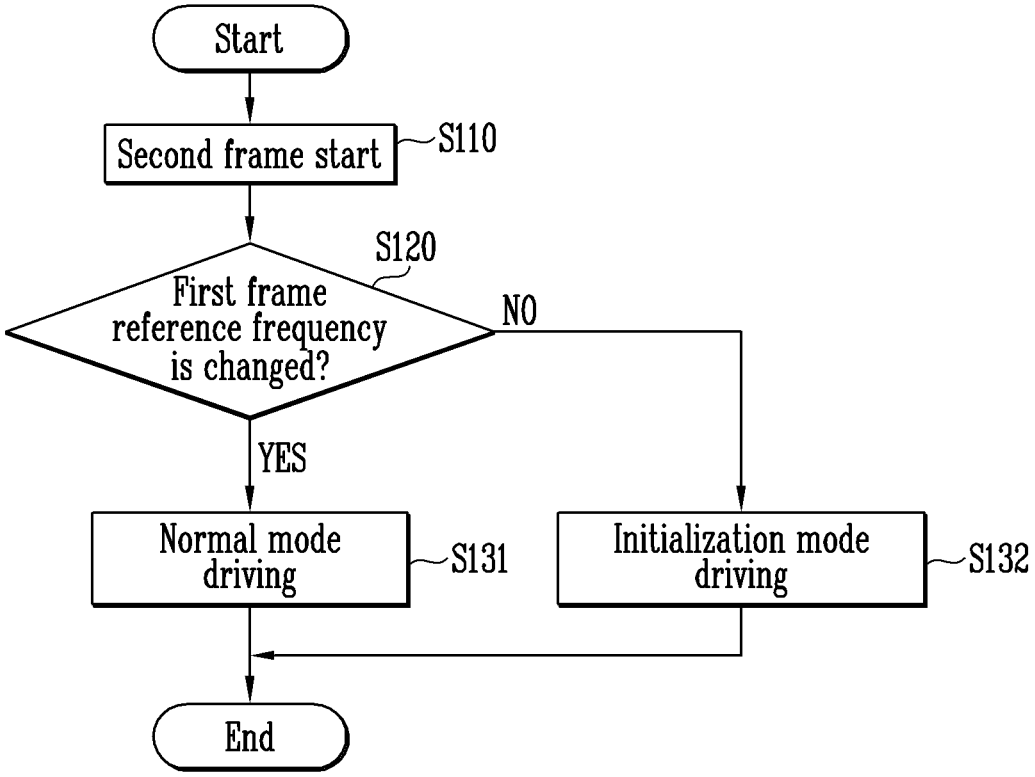
FIG. 6 illustrates a schematic flowchart of a driving method of a display device according to an embodiment of the present disclosure.
Figure 7:
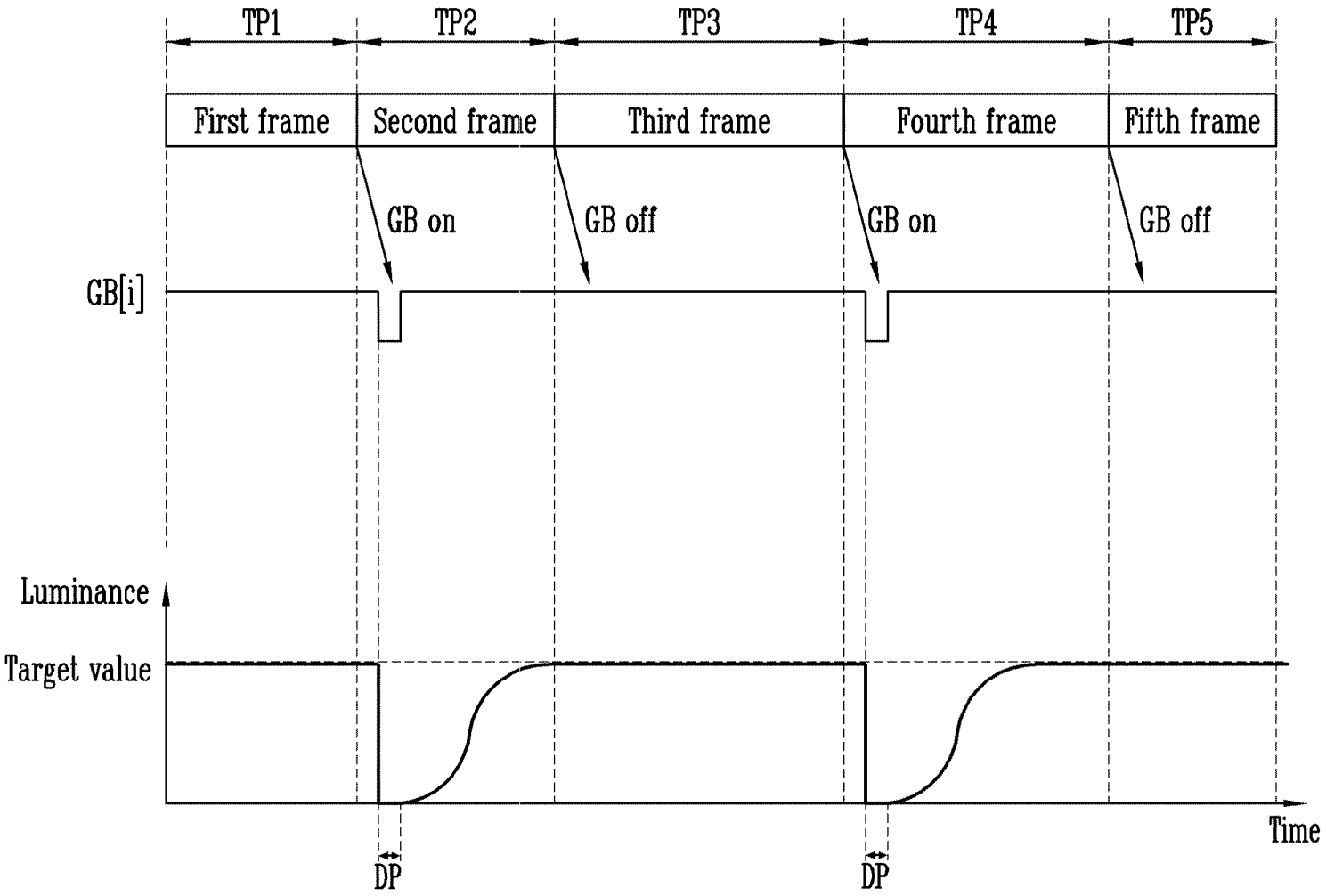
FIG. 7 illustrates a timing chart and a graph of luminance versus time according to some of the flow of the driving method of FIG. 6.
Figure 8:
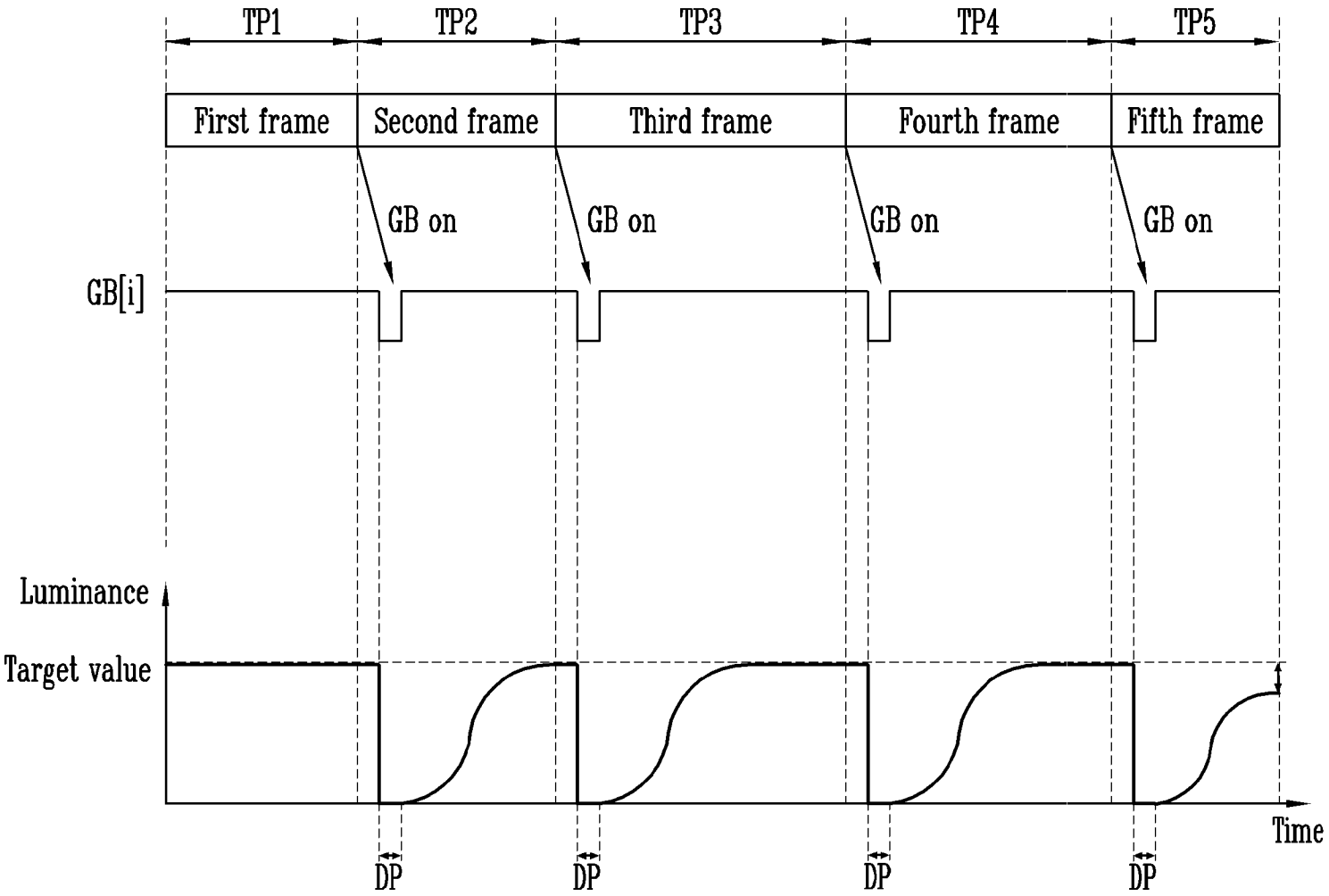
FIG. 8 illustrates a timing chart and a graph of luminance versus time according to a comparative example with FIG. 7.

FIG. 6 illustrates a schematic flowchart of a driving method of a display device according to an embodiment of the present disclosure. FIG. 7 illustrates a timing chart and a graph of luminance versus time according to some of the flow of the driving method of FIG. 6. FIG. 8 illustrates a timing chart and a graph of luminance versus time according to a comparative example with FIG. 7. For convenience of illustration, FIG. 7 and FIG. 8 illustrate only the first scan signal (e.g., applied to the seventh transistor T7) GB[i] (e.g., having one pulse) from among the signals (for example, the signals EM[i], GI[i], GW[i], GC[i], and GB[i] of FIG. 4) applied to the pixel PXL of FIG. 2.

In FIG. 6, the driving method of the display device is described in reference to a second frame, which is the next frame of a first frame, and the description of the second frame may be applied to other frames. In other words, the first frame corresponds to a frame immediately preceding the second frame.

Referring to FIG. 6, the driving method of the display device according to an embodiment may include a second frame start operation S110, a previous frame reference frequency change determination operation S120, a normal mode driving operation S131, and an initialization mode driving operation S132. Although each operation is described as being performed sequentially according to the order of the flowchart shown in FIG. 6, the present disclosure is not limited thereto, and some of the operations shown in FIG. 6 as being sequentially or continuously performed may be concurrently (e.g., simultaneously) performed, the order of some of the operations may be changed, some of the operations may be omitted, or one or more other operations may be added between respective operations of FIG. 6, unless expressed otherwise.

First, the display device 1 may perform the second frame start operation S110. In the driving method of the display device 1, the second frame start operation S110 may refer to driving the pixels PXL at a time when the second frame starts after the first frame is ended. In other words, in the second frame start operation S110, the display device 1 is in a state of a boundary time point at which the first frame ends and the second frame starts.

Thereafter, the display device 1 may perform the previous frame reference frequency change determination operation S120. The previous frame reference frequency change determination operation S120 includes, for example, an operation of determining whether the frequency of the second frame, which is the current frame, is changed compared to the frequency of the first frame, which is the previous frame, or whether a rate of change therebetween is greater than or equal to a suitable reference value (e.g., a predetermined reference value).

When the display device 1 determines in the previous frame reference frequency change determination operation S120 that the frequency of the second frame, which is the current frame, is changed compared to the frequency of the first frame, which is the previous frame, or the rate of change therebetween is greater than or equal to the reference value, the display device 1 may perform the normal mode driving operation S131. In addition, when the display device 1 determines in the previous frame reference frequency change determination operation S120 that the frequency of the second frame, which is the current frame, is not changed compared to the frequency of the first frame, which is the previous frame, or the rate of change therebetween is less than the reference value, the display device 1 may perform the initialization mode driving operation S132.

In the normal mode driving operation S131, the 'normal mode' corresponds to a driving method in which the first scan driver 20*a* is controlled so that the initialization controller 100 does not provide the first scan signal (e.g., applied to the seventh transistor T7) of the gate-on level to each pixel in the second frame (which is the current frame) (or in other words, the first scan signal (e.g., applied to the seventh transistor T7) does not include the gate-on level in the second frame), and accordingly, the anode of the light emitting element LD is not initialized with the second initialization voltage VINT2 in the second frame.

In the initialization mode driving operation S132, the 'initialization mode' corresponds to a driving method in which the first scan driver 20*a* is controlled so that the initialization controller 100 provides the first scan signal (e.g., applied to the seventh transistor) of the gate-on level to each pixel in the second frame (which is the current frame) (or in other words, the first scan signal (e.g., applied to the seventh transistor) includes the gate-on level in the second frame), and accordingly, the anode of the light emitting element LD is initialized with the second initialization voltage VINT2 in the second frame.

In other words, depending on whether the frequency of the current frame is changed compared to the frequency of the previous frame, or whether the rate of change therebetween is greater than or equal to the reference value, the display device 1 may determine whether to be driven in the normal mode or the initialization mode in the current frame.

FIG. 7 illustrates an example in which a time period TP1 of the first frame has the same or substantially the same length as that of a time period TP2 of the second frame, a time period TP3 of a third frame is longer than the time period TP2 of the second frame, a time period TP4 of a fourth frame has the same or substantially the same length as that of the time period TP3 of the third frame, and a time period TP5 of a fifth frame is shorter than the time period TP4 of the fourth frame. In other words, FIG. 7 illustrates that a frequency of the second frame is equal to or substantially equal to a frequency of the first frame, a frequency of the third frame is lower than the frequency of the second frame, a frequency of the fourth frame is equal to or substantially equal to the frequency of the third frame, and a frequency of the fifth frame is higher than the frequency of the fourth frame.

Referring to FIGS. 6 and 7, because the time period TP2 of the second frame is the same as or substantially the same as the time period TP1 of the first frame (e.g., because the frequency of the second frame and the frequency of the first frame are the same or substantially the same as each other), the display device 1 in the second frame may be driven in the initialization mode. In the second frame, the first scan signal (e.g., applied to the seventh transistor T7) of the gate-on level may be provided to each pixel, and the anode of the light emitting element in each pixel may be initialized to a voltage level corresponding to the second initialization voltage VINT2.

When the first scan signal (e.g., applied to the seventh transistor T7) GB[i] of the gate-on level (e.g., GB on) is provided to each pixel in the second frame, the anode of the light emitting element is initialized to a voltage level corresponding to the second initialization voltage VINT2, and accordingly, a luminance of each pixel may have a minimum value. In this case, the display device 1 may include a delay period DP in which the luminance may not immediately increase, even if a voltage signal corresponding to the data voltage is provided, after the second initialization voltage is provided, to the anode of the light emitting element in each pixel in terms of luminance. The delay period DP may be caused by a capacitance component (e.g., a parasitic capacitance) of the light emitting element. After the delay period DP, the luminance may gradually increase until the light emitting element in each pixel emit light with a target luminance (e.g., a target value).

Because the time period TP3 of the third frame is longer than the time period TP2 of the second frame (e.g., the frequency of the third frame is lower than the frequency of the second frame), the display device 1 may be driven in the normal mode in the third frame In other words, the anode of the light emitting element in each pixel may not be initialized in the third frame. In the third frame, the first scan signal (e.g., applied to the seventh transistor T7) GB[i] of the gate-off level (e.g., GB off) may be maintained or substantially maintained to be provided to each pixel, and the light emitting element in each pixel may be maintained or substantially maintained to emit light with a target luminance. In some embodiments, at a boundary between the third frame and the second frame, the luminance may be lowered (e.g., may be slightly lowered) and may be recovered, but the present disclosure is not limited thereto.

Because the time period TP4 of the fourth frame is the same or substantially the same as the time period TP3 of the third frame (e.g., because the frequency of the fourth frame and the frequency of the third frame are the same or substantially the same as each other), the display device 1 may be driven in the initialization mode in the fourth frame. In the fourth frame, the first scan signal (e.g., applied to the seventh transistor T7) GB[i] of the gate-on level (e.g., GB on) may be provided to each pixel, and the anode of the light emitting element in each pixel may be initialized to a voltage level corresponding to the second initialization voltage VINT2.

When the first scan signal (e.g., applied to the seventh transistor T7) GB[i] of the gate-on level (e.g., GB on) is provided to each pixel in the fourth frame, the anode of the light emitting element is initialized to a voltage level corresponding to the second initialization voltage VINT2, and accordingly, the luminance of each pixel may have a minimum value. In this case, the display device 1 may have the delay period DP, and the luminance may increase (e.g., may gradually increase) until the light emitting element in each pixel emit light with a target luminance after the delay period DP.

Because the time period TP5 of the fifth frame is shorter than the time period TP4 of the fourth frame (e.g., because the frequency of the fifth frame is higher than the frequency of the fourth frame), the display device 1 may be driven in the normal mode in the fifth frame. In other words, the anode of the light emitting element in each pixel may not be initialized in the fifth frame. In the fifth frame, the first scan signal (e.g., applied to the seventh transistor T7) GB[i] of the gate-off level (e.g., GB off) may be maintained or substantially maintained to be provided to each pixel, and the light emitting element in each pixel may be maintained or substantially maintained to emit light with a target luminance.

As described above, when the frequency of the current frame is changed compared to the frequency of the previous frame, or the rate of change therebetween is greater than or equal to the reference value, it may be possible to minimize or reduce the flicker observed (e.g., viewed) by a user by driving the display device in the normal mode in the current frame.

Referring to the comparative example shown in FIG. 8, the comparative example illustrates that the display device is driven in the initialization mode in all frames (e.g., in each of the frames).

In the comparative example, because the anode of the light emitting element in each pixel is initialized to the second initialization voltage for each frame, the pixels according to the comparative example may change in luminance at irregular intervals. When the luminance of the pixels changes at irregular intervals within a relatively short period of time compared to the embodiment of FIG. 7, the flicker may be easily observed (e.g., may be easily viewed) by the user.

For example, in the fifth frame of the comparative example, after the anode of each pixel is initialized to the second initialization voltage, the frame may be ended before the light emitting element in each pixel emits light with the target luminance. In this case, the flicker may be easily observed (e.g., easily viewed) by the user.

Hereinafter, a display device according to another embodiment will be described. In the following description, the same or similar reference numerals are used for the same or substantially the same constituent elements as those of FIG. 1 to FIG. 8, and thus, redundant description thereof may not be repeated.

Figure 9:
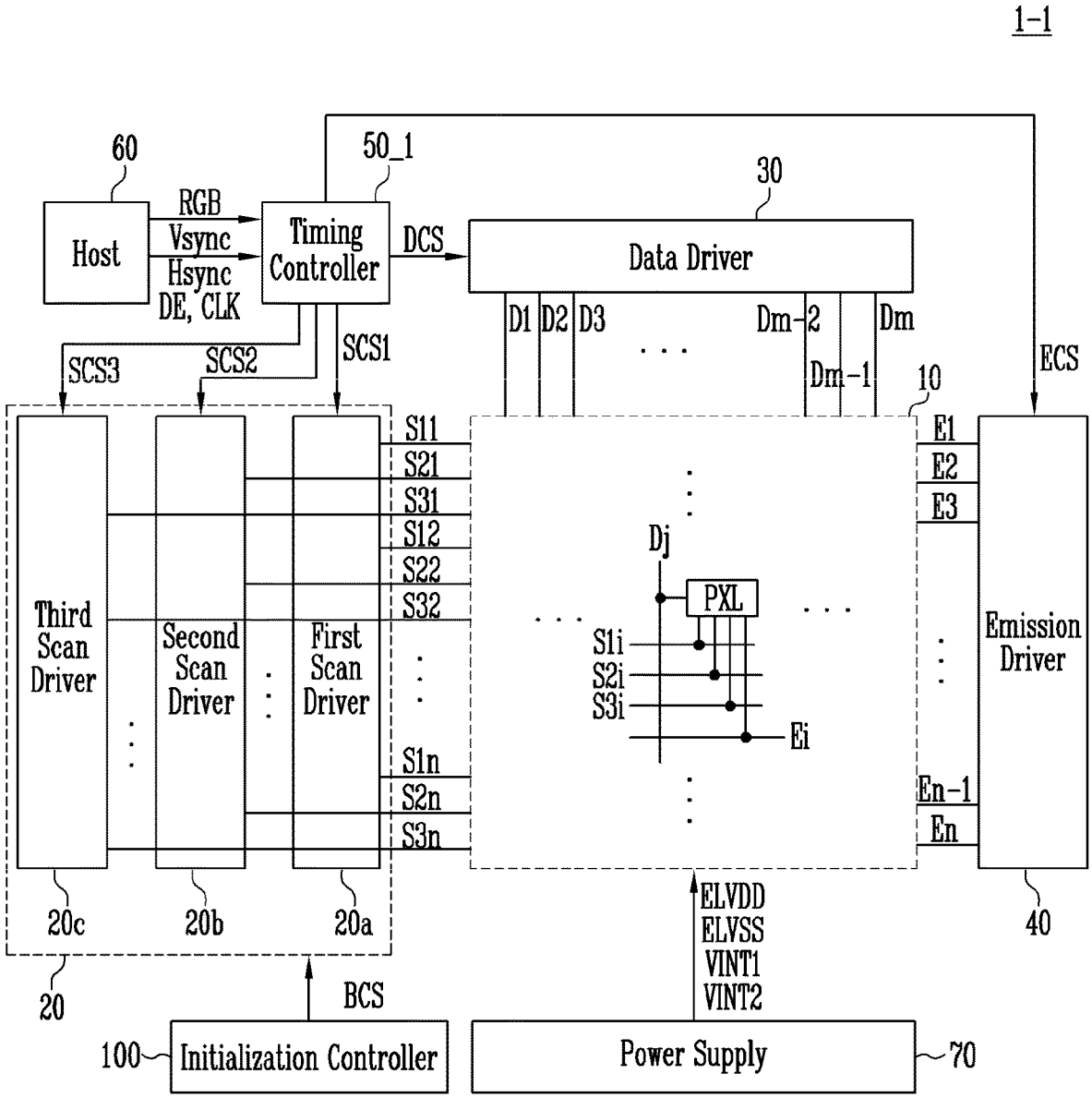
FIG. 9 illustrates a schematic block diagram of a display device according to another embodiment of the present disclosure.

FIG. 9 illustrates a schematic block diagram of a display device according to another embodiment of the present disclosure.

Referring to FIG. 9, a display device 1-1 according to the present embodiment may be different from the display device 1 according to the embodiment of FIG. 1, in that the initialization controller 100 of FIG. 9 is provided separately from the timing controller 50.

In the embodiment of FIG. 9, the initialization controller 100 is provided separately from the pixel part 10, the scan driver 20, the data driver 30, the emission driver 40, the timing controller 50, the host 60, and the power supply 70, and the initialization controller 100 may control the scan driver 20 (for example, the first scan driver 20*a*).

In the present embodiment, when the initialization controller 100 compares the frequency (e.g., the time period) of the current frame with the frequency (e.g., the time period) of the previous frame, and determines that a rate of change therebetween does not exceed a suitable reference value (e.g., a predetermined reference value), the initialization controller 100 may control the first scan driver 20*a* not to provide the first scan signal (e.g., applied to the seventh transistor T7) of the gate-on level (or in other words, to provide the first scan signal applied to the seventh transistor T7 of the gate-off level) to each pixel.

Figure 10:
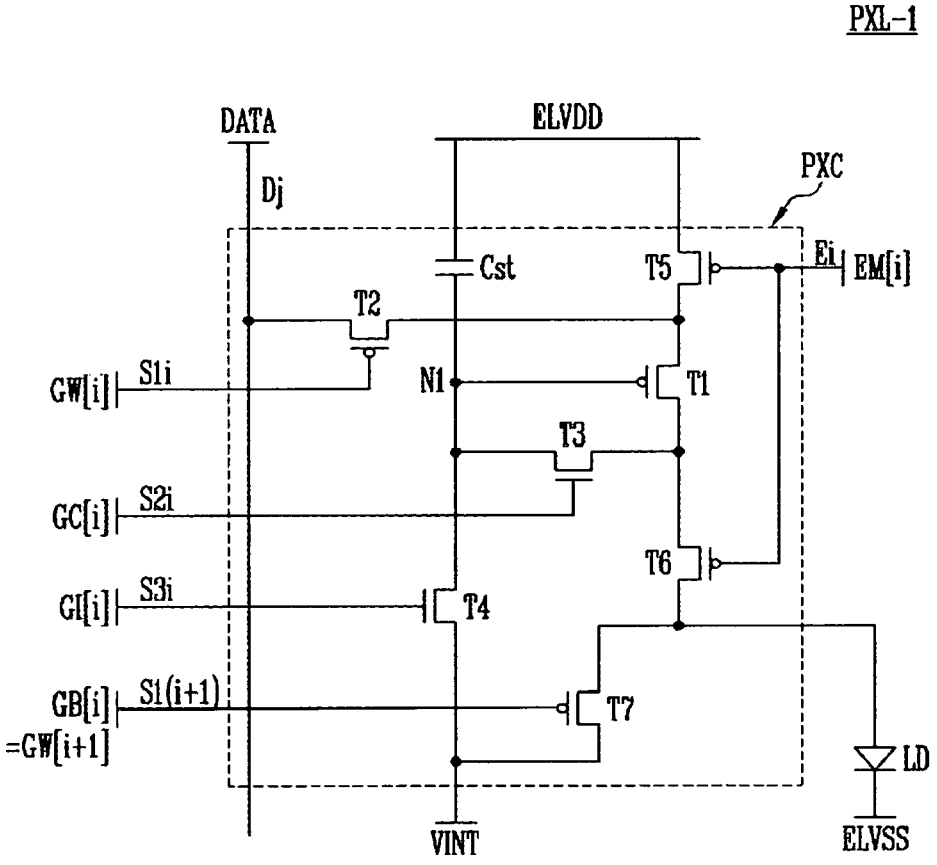
FIG. 10 illustrates a circuit diagram of a pixel of a display device according to another embodiment of the present disclosure.

FIG. 10 illustrates a circuit diagram of a pixel of a display device according to another embodiment of the present disclosure.

Referring to FIG. 10, a pixel PXL-1 of the present embodiment may be different from the pixel PXL according to the embodiment of FIG. 2, in that the same initialization voltage VINT is provided to the gate electrode of the first transistor T1 (e.g., the driving transistor) and the anode of the light emitting element LD.

The fourth transistor T4 (e.g., the gate initialization transistor) may be connected between the first node N1 and an initialization power line to which the initialization voltage VINT is applied.

The seventh transistor T7 (e.g., the anode initialization transistor) may be connected between the initialization power line to which the initialization voltage VINT is applied and the first electrode of the light emitting element LD, for example, the anode of the light emitting element LD.

Figure 11:
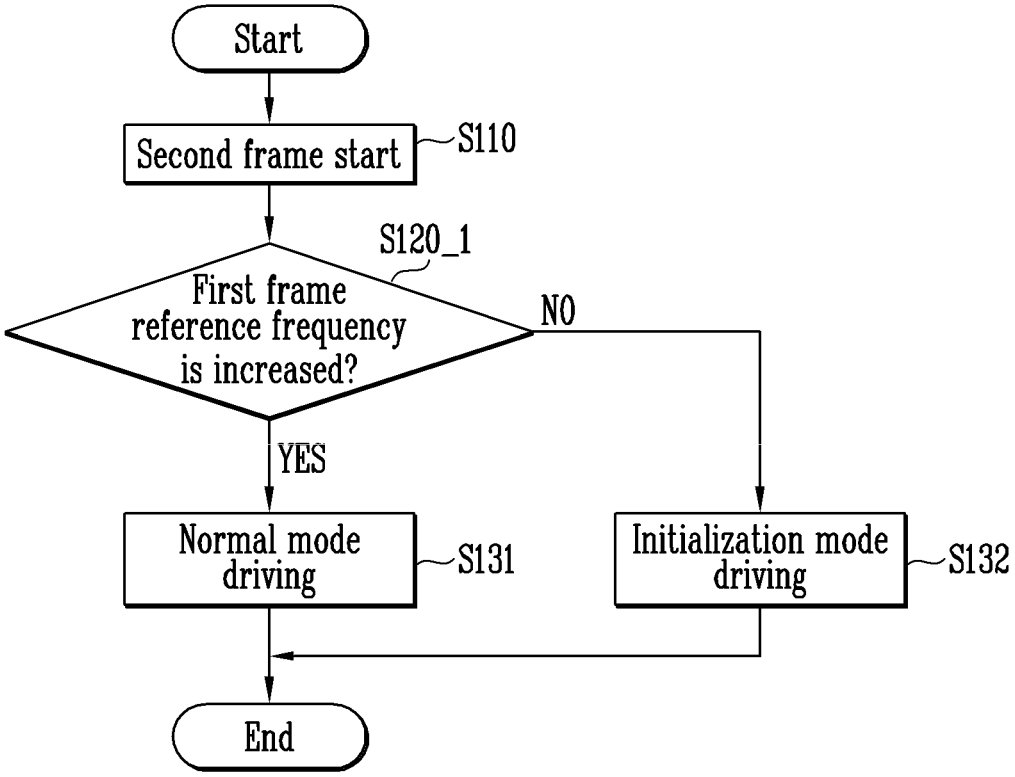
FIG. 11 illustrates a schematic flowchart of a driving method of a display device according to another embodiment of the present disclosure.
Figure 12:
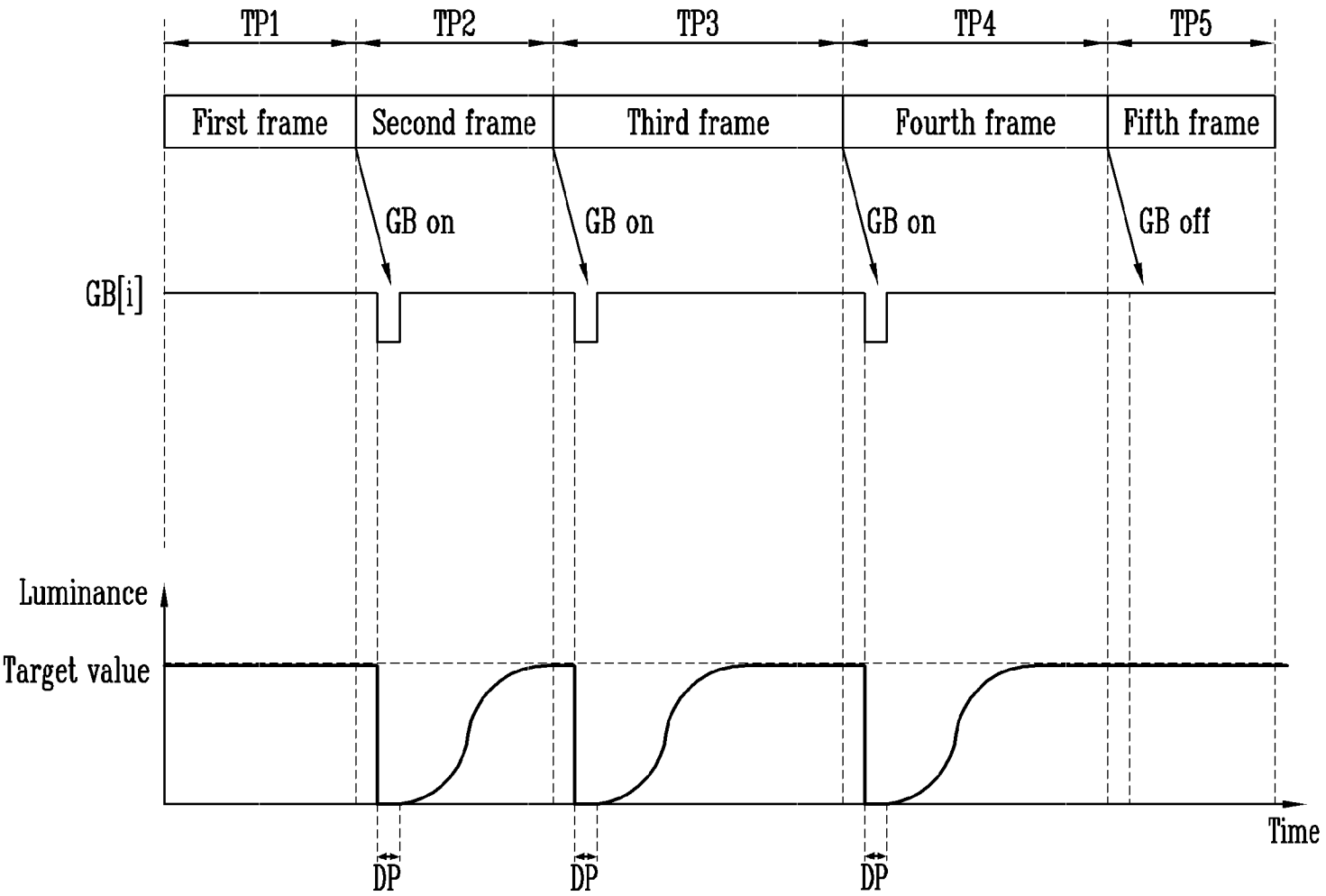
FIG. 12 illustrates a timing diagram and a graph of luminance versus time according to some of the flow of the driving method of FIG. 11.

FIG. 11 illustrates a schematic flowchart of a driving method of a display device according to another embodiment of the present disclosure. FIG. 12 illustrates a timing diagram and a graph of luminance versus time according to some of the flow of the driving method of FIG. 11.

Referring to FIG. 11, the driving method of the display device of FIG. 11 may differ from the driving method of FIG. 6, in that a previous frame reference frequency increase determination operation S120_1 is included in FIG. 11, instead of the previous frame reference frequency change determination operation S120 in FIG. 6.

The previous frame reference frequency increase determination operation S120_1 includes, for example, an operation of determining whether the frequency of the second frame, which is the current frame, is increased compared to the frequency of the first frame, which is the previous frame, or whether a change rate of increase thereof is greater than or equal to a suitable reference value (e.g., a predetermined reference value).

When the display device determines in the previous frame reference frequency increase determination operation S120_1 that the frequency of the second frame, which is the current frame, is increased compared to the frequency of the first frame, which is the previous frame, or the change rate of increase thereof is greater than or equal to the reference value, the display device may perform the normal mode driving operation S131. When the display device determines in the previous frame reference frequency increase determination operation S120_1 that the frequency of the second frame, which is the current frame, is not changed or is decreased compared to the frequency of the first frame, which is the previous frame, or the change rate of increase thereof is less than the reference value, the display device may perform the initialization mode driving operation S132.

As in FIG. 7, FIG. 12 illustrates an example in which the time period TP1 of the first frame has the same or substantially the same length as that of the time period TP2 of the second frame, the time period TP3 of the third frame is longer than the time period TP2 of the second frame, the time period TP4 of the fourth frame has the same or substantially the same length as that of the time period TP3 of the third frame, and the time period TP5 of the fifth frame is shorter than the time period TP4 of the fourth frame. In other words, FIG. 12 illustrates that the frequency of the second frame is equal to or substantially equal to the frequency of the first frame, the frequency of the third frame is lower than the frequency of the second frame, the frequency of the fourth frame is equal to or substantially equal to the frequency of the third frame, and the frequency of the fifth frame is higher than the frequency of the fourth frame.

Referring to FIGS. 11 and 12, because the time period TP2 of the second frame has the same or substantially the same length as that of the time period TP1 of the first frame (in other words, because the frequency of the second frame and the frequency of the first frame are the same or substantially the same as each other), the display device may be driven in the initialization mode in the second frame. In the second frame, the first scan signal (e.g., applied to the seventh transistor T7) of the gate-on level may be provided to each pixel, and the anode of the light emitting element in each pixel may be initialized to a voltage level corresponding to the second initialization voltage VINT2.

When the first scan signal (e.g., applied to the seventh transistor T7) GB[i] of the gate-on level (e.g., GB on) is provided to each pixel in the second frame, the anode of the light emitting element is initialized to a voltage level corresponding to the second initialization voltage VINT2, and accordingly, the luminance of each pixel may have a minimum value. Thereafter, the display device may include the delay period DP. After the delay period DP, the luminance may increase (e.g., may gradually increase) until the light emitting element in each pixel emits light with a target luminance (e.g., a target value).

Because the time period TP3 of the third frame is longer than the time period TP2 of the second frame (in other words, because the frequency of the third frame is lower than the frequency of the second frame), the display device may be driven in the initialization mode in the third frame. In other words, in the third frame, the first scan signal (e.g., applied to the seventh transistor T7) GB[i] of the gate-on level (e.g., GB on) may be provided to each pixel, and the anode of the light emitting element in each pixel may be initialized to a voltage level corresponding to the second initialization voltage VINT2.

When the first scan signal (e.g., applied to the seventh transistor T7) GB[i] of the gate-on level (e.g., GB on) is provided to each pixel in the third frame, the anode of the light emitting element is initialized to a voltage level corresponding to the second initialization voltage VINT2, and accordingly, the luminance of each pixel may have a minimum value. Thereafter, the display device has the delay period DP, and the luminance may increase (e.g., may gradually increase) until the light emitting element in each pixel emits light with a target luminance after the delay period DP.

Because the time period TP4 of the fourth frame has the same or substantially the same length as that of the time period TP3 of the third frame (in other words, because the frequency of the fourth frame and the frequency of the third frame are the same or substantially the same as each other), the display device may be driven in the initialization mode in the fourth frame. In the fourth frame, the first scan signal (e.g., applied to the seventh transistor T7) GB[i] of the gate-on level (e.g., GB on) may be provided to each pixel, and the anode of the light emitting element in each pixel may be initialized to a voltage level corresponding to the second initialization voltage VINT2.

When the first scan signal (e.g., applied to the seventh transistor T7) GB[i] of the gate-on level (e.g., GB on) is provided to each pixel in the fourth frame, the anode of the light emitting element is initialized to a voltage level corresponding to the second initialization voltage VINT2, and accordingly, the luminance of each pixel may have a minimum value. Thereafter, the display device has the delay period DP, and the luminance may increase (e.g., may gradually increase) until the light emitting element in each pixel emits light with a target luminance after the delay period DP.

Because the time period TP5 of the fifth frame is shorter than the time period TP4 of the fourth frame (in other words, because the frequency of the fifth frame is higher than the frequency of the fourth frame), the display device may be driven in the normal mode in the fifth frame. In other words, the anode of the light emitting element in each pixel may not be initialized in the fifth frame. In the fifth frame, the first scan signal (e.g., applied to the seventh transistor T7) GB[i] of the gate-off level (e.g., GB off) may be maintained or substantially maintained to be provided to each pixel, and the light emitting element in each pixel may be maintained or substantially maintained to emit light with the target luminance.

Even if the time period TP5 is relatively short as in the fifth frame, it may be possible for the light emitting element in each pixel to emit light with the target luminance by being driven and maintained in the normal mode, so that the light emitting element in the pixel emits light with the target luminance. Therefore, it may be possible to minimize or reduce the flicker that may be observed (e.g., that may be viewed) by the user.

Figure 13:
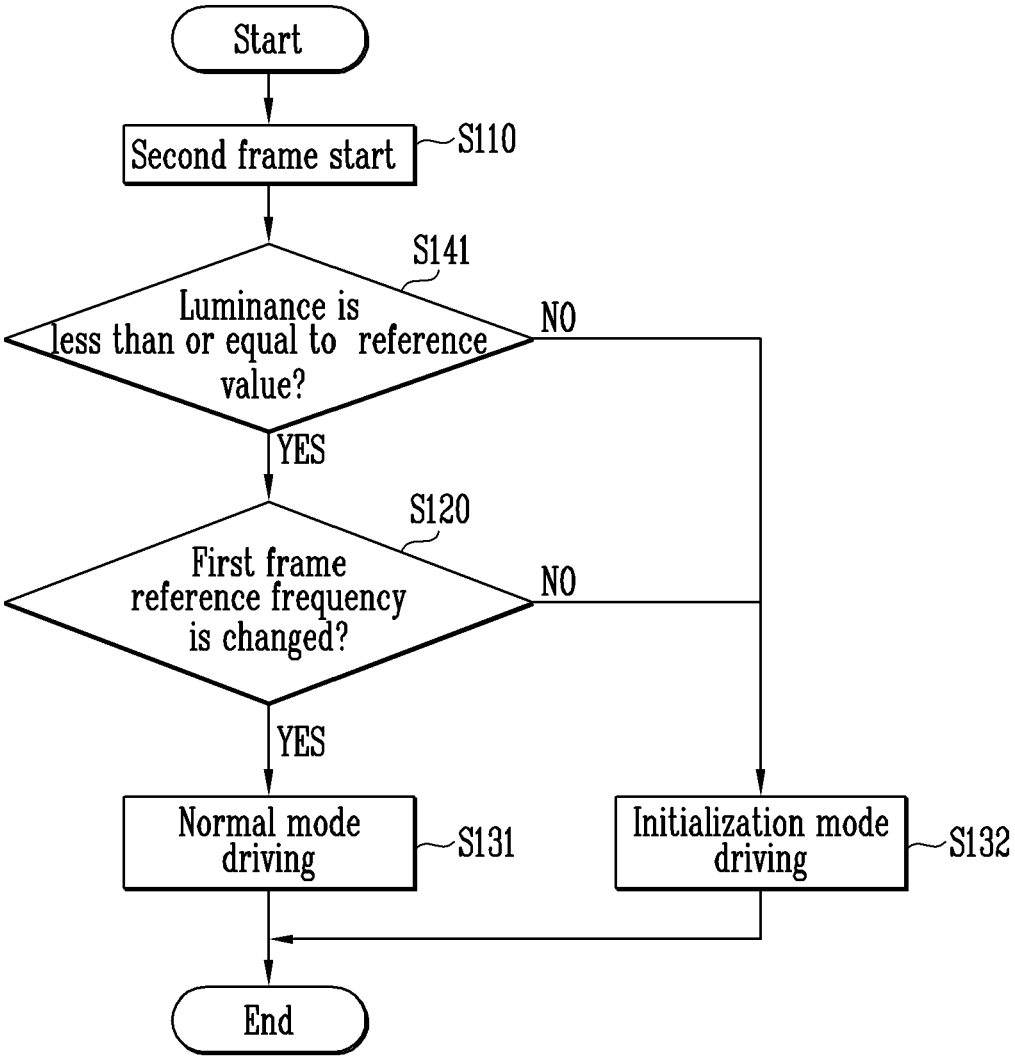
FIG. 13 illustrates a schematic flowchart of a driving method of a display device according to another embodiment of the present disclosure.

FIG. 13 illustrates a schematic flowchart of a driving method of a display device according to another embodiment of the present disclosure.

Referring to FIG. 13, the driving method of the display device of FIG. 13 may be different from the driving method of FIG. 6, in that an operation S141 of determining whether the luminance is less than or equal to a reference value is further included in FIG. 13.

In the embodiment of FIG. 13, after the second frame start operation S110, the operation S141 of determining whether the luminance is less than or equal to the reference value may be performed.

The operation S141 of determining whether the luminance is less than or equal to the reference value corresponds to an operation of determining whether the luminance is less than or equal to a suitable reference value (e.g., a predetermined reference value) in the current frame.

At a relatively high luminance, it may be difficult for a user to recognize a luminance difference between frames, so when the luminance exceeds the reference value, the flicker may not be observed (e.g., may not be viewed) by the user even if the initialization mode driving operation S132 is performed.

The reference value of the luminance may be set by one or more registers of the timing controller 50.

When, in the operation S141 of determining whether the luminance is less than or equal to the reference value, the luminance is determined to be less than or equal to the reference value in the current frame, then the previous frame reference frequency change determination operation S120 may be performed. On the other hand, when the luminance is determined to be greater than the reference value at operation S141, then the initialization mode driving operation S132 is performed.

However, the embodiment of FIG. 13 is not limited to the order of operation S141 of determining whether the luminance is equal to or less than the reference value and the previous frame reference frequency change determination operation S120. For example, in another embodiment, the previous frame reference frequency change determination operation S120 may be performed first, and after performing the previous frame reference frequency change determination operation S120, the operation S141 of determining whether the luminance is equal to or less than the reference value may be performed. In this case, when there is a change in frequency in the previous frame reference frequency change determination operation S120, or when the rate of change between the first and second frames is determined to be greater than or equal to a suitable reference value (e.g., a predetermined reference value), operation S141 of determining whether the luminance is equal to or less than the reference value may be performed. On the other hand, when there is no change in frequency, or when the rate of change between the current frame and the previous frame is determined to be less than a suitable reference value (e.g., a predetermined reference value), the initialization mode driving operation S132 may be performed.

Figure 14:
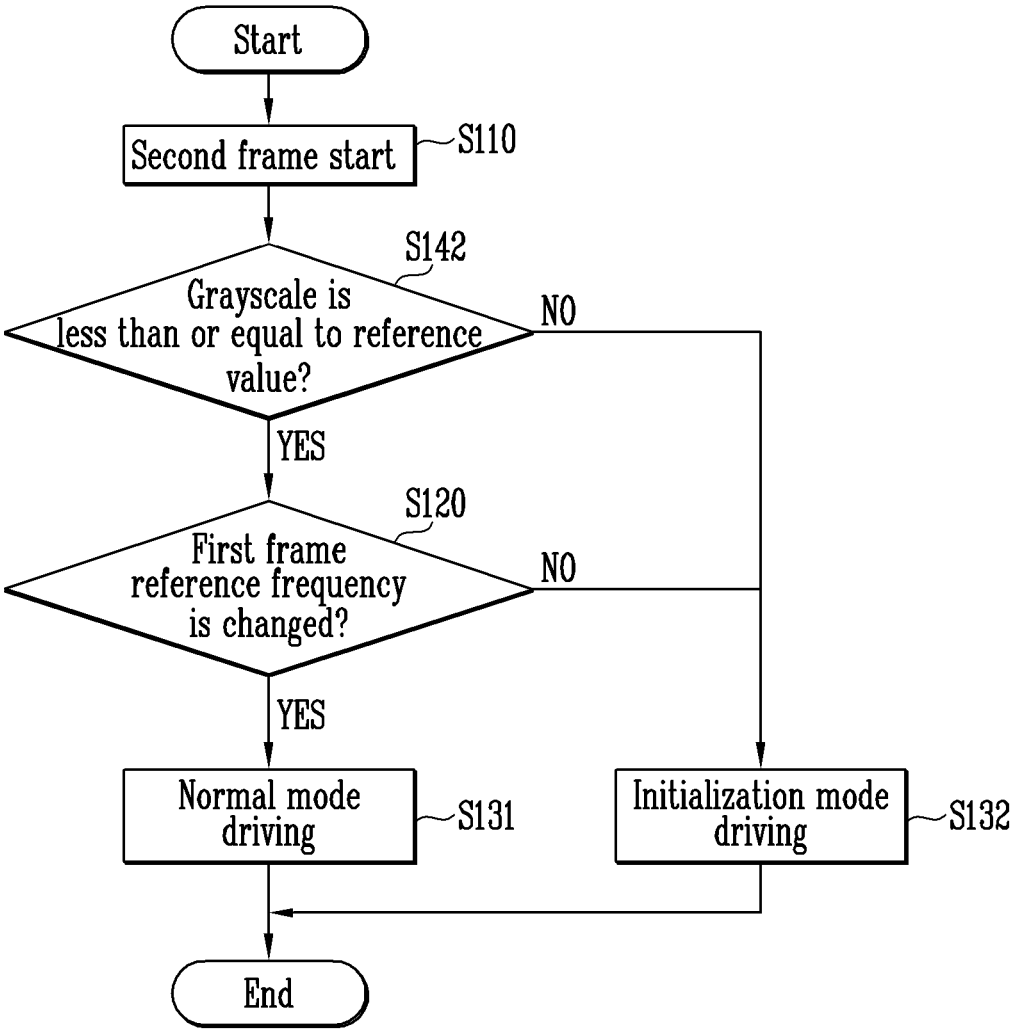
FIG. 14 illustrates a schematic flowchart of a driving method of a display device according to another embodiment of the present disclosure.

FIG. 14 illustrates a schematic flowchart of a driving method of a display device according to another embodiment of the present disclosure.

Referring to FIG. 14, the driving method of the display device of FIG. 14 may be different from the driving method of FIG. 6, in that an operation S142 of determining whether a grayscale (e.g., a grayscale value) is less than or equal to a reference value is further included in FIG. 14.

In the embodiment of FIG. 14, after the second frame start operation S110, the operation S142 of determining whether the grayscale is less than or equal to the reference value may be performed.

The operation S142 of determining whether the grayscale is less than or equal to the reference value corresponds to an operation of determining whether the grayscale is less than or equal to a suitable reference value (e.g., a predetermined reference value) in the current frame.

Because the delay period DP is relatively short at a relatively high grayscale (e.g., a relatively high grayscale value), it may be difficult for a user to recognize a luminance difference between frames, so when the grayscale exceeds the reference value, the flicker may not be observed (e.g., may not be viewed) by the user even if the initialization mode driving operation S132 is performed.

The reference value of the grayscale may be set by one or more registers of the timing controller 50.

When, in the operation S142 of determining whether the grayscale is less than or equal to the reference value, the grayscale is determined to be less than or equal to the reference value in the current frame, then the previous frame reference frequency change determination operation S120 may be performed. On the other hand, when the grayscale is greater than the reference value at operation S142, the initialization mode driving operation S132 may be performed.

However, the embodiment of FIG. 14 is not limited to the order of operation S142 of determining whether the grayscale is equal to or less than the reference value and the previous frame reference frequency change determination operation S120. For example, in another embodiment, the previous frame reference frequency change determination operation S120 may be performed first, and after performing the previous frame reference frequency change determination operation S120, the operation S142 of determining whether the grayscale is equal to or less than the reference value may be performed. In this case, when there is a change in frequency in the previous frame reference frequency change determination operation S120, or when the rate of change between the first and second frames is determined to be greater than or equal to a suitable reference value (e.g., a predetermined reference value), the operation S142 of determining whether the grayscale is equal to or less than the reference value may be performed. On the other hand, when there is no change in frequency, or when the rate of change between the first and second frames is determined to be less than the reference value, the initialization mode driving operation S132 may be performed.

Figure 15:
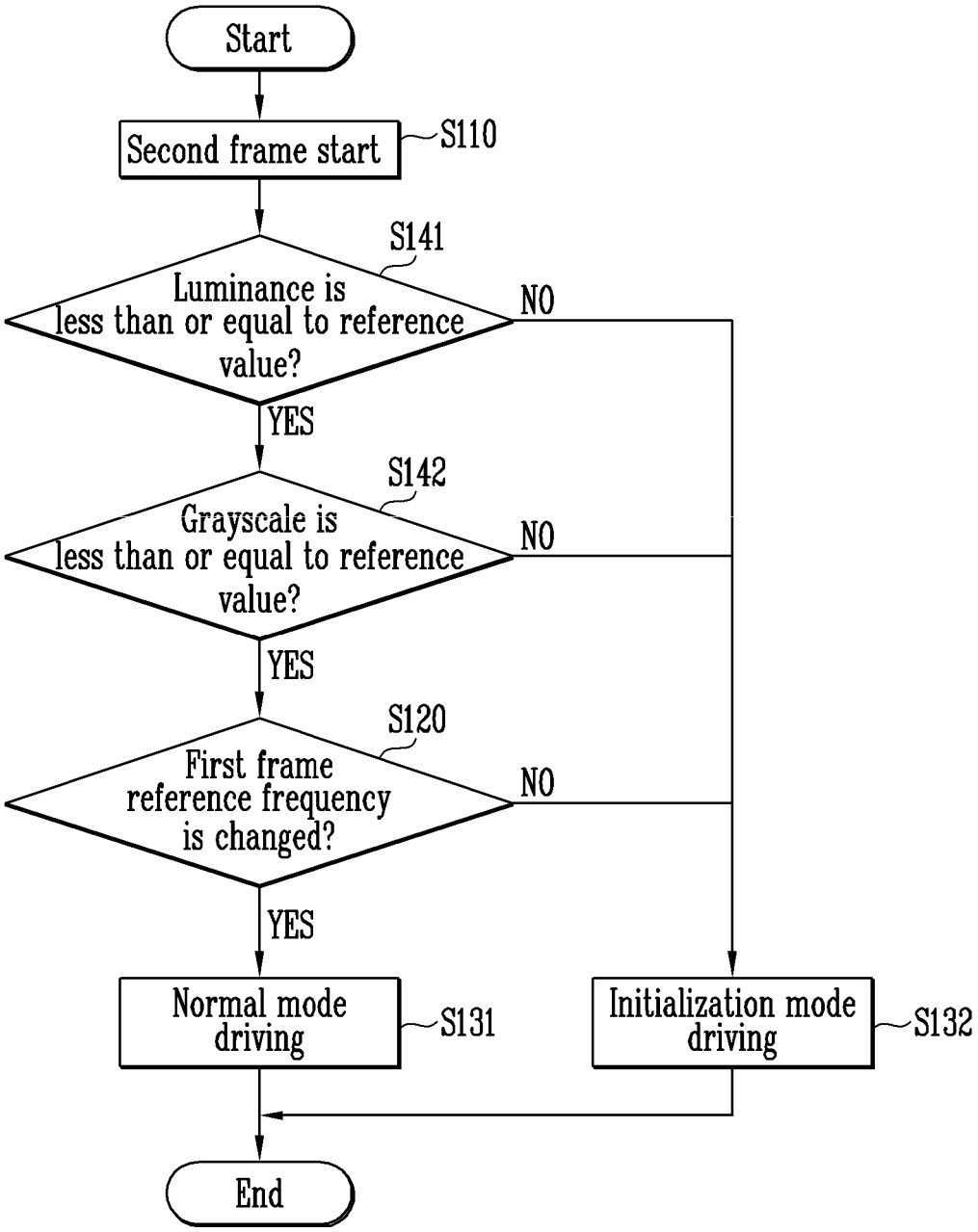
FIG. 15 illustrates a schematic flowchart of a driving method of a display device according to another embodiment of the present disclosure.

FIG. 15 illustrates a schematic flowchart of a driving method of a display device according to another embodiment of the present disclosure.

Referring to FIG. 15, the driving method of the display device of FIG. 15 may be different from the driving method of FIG. 13, in that an operation S142 of determining whether a grayscale (e.g., a grayscale value) is less than or equal to a reference value is further included in FIG. 15.

In the embodiment of FIG. 15, after the second frame start operation S110, the operation S141 of determining whether the luminance is less than or equal to the reference value may be performed. When, in the operation S141 of determining whether the luminance is less than or equal to the reference value, the luminance is determined to be less than or equal to the reference value in the current frame, then operation S142 of determining whether the grayscale is less than or equal to a reference value may be performed. When, in the operation S142 of determining whether the grayscale is less than or equal to the reference value, the grayscale is determined to be less than or equal to the reference value in the current frame, then the previous frame reference frequency change determination operation S120 may be performed.

However, the embodiment of FIG. 15 is not limited to the order of operation S141 of determining whether the luminance is less than or equal to the reference value, operation S142 of determining whether the grayscale is less than or equal to the reference value, and the previous frame reference frequency change determination operation S120, and the order of these operations may be various modified as needed or desired as would be understood from those having ordinary skill in the art.

Although some example embodiments have been described, those skilled in the art will readily appreciate that various modifications are possible in the example embodiments without departing from the spirit and scope of the present disclosure. It will be understood that descriptions of features or aspects within each embodiment should typically be considered as available for other similar features or aspects in other embodiments, unless otherwise described. Thus, as would be apparent to one of ordinary skill in the art, features, characteristics, and/or elements described in connection with a particular embodiment may be used singly or in combination with features, characteristics, and/or elements described in connection with other embodiments unless otherwise specifically indicated. Therefore, it is to be understood that the foregoing is illustrative of various example embodiments and is not to be construed as limited to the specific example embodiments disclosed herein, and that various modifications to the disclosed example embodiments, as well as other example embodiments, are intended to be included within the spirit and scope of the present disclosure as defined in the appended claims, and their equivalents.

What is claimed is:

1. A display device comprising:

a pixel part comprising a plurality of pixels;

a first scan driver configured to provide a first scan signal to each of the pixels; and an initialization controller configured to control the first scan driver, wherein each of the pixels comprises a pixel circuit comprising a plurality of transistors, and a light emitting element connected to the pixel circuit, wherein an anode of the light emitting element is configured to be initialized to a first initialization voltage in response to the first scan signal having a gate-on level, and wherein the initialization controller is configured to determine a frequency for each frame, and determine whether to provide the first scan signal having the gate-on level to each of the pixels for each frame according to a change in frequency of each frame.

2. The display device of claim 1, further comprising:

a timing controller configured to provide a scan driving control signal to the first scan driver.

3. The display device of claim 1, wherein the plurality of transistors comprise a P-type transistor and an N-type transistor.

4. The display device of claim 1, wherein the initialization controller comprises:

a frequency determiner configured to determine the frequency for each frame; and a control signal output configured to provide a black voltage control signal to the first scan driver according to the frequency determined by the frequency determiner.

5. The display device of claim 4, wherein the initialization controller is configured to control the first scan driver to not provide the first scan signal having the gate-on level when there is the change in frequency in a current frame compared to a previous frame.

6. The display device of claim 5, wherein the initialization controller is configured to control the first scan driver to provide the first scan signal having the gate-on level when there is no change in frequency in the current frame compared to the previous frame.

7. The display device of claim 1, further comprising:

a power supply configured to provide the first initialization voltage.

8. The display device of claim 7, wherein the power supply is configured to provide a second initialization voltage to initialize a gate electrode of a driving transistor from among the plurality of transistors.

9. The display device of claim 8, further comprising:

a second scan driver configured to provide a second scan signal, wherein the second initialization voltage is provided to the gate electrode of the driving transistor in response to the second scan signal having a gate-on level.

10. A display device comprising:

a pixel part comprising a plurality of pixels;

a first scan driver configured to provide a first scan signal to each of the pixels;

an initialization controller configured to provide a black voltage control signal to control the first scan driver; and a timing controller configured to provide a scan driving control signal to the first scan driver, wherein each of the pixels comprises a pixel circuit comprising a plurality of transistors, and a light emitting element connected to the pixel circuit, wherein an anode of the light emitting element is configured to be initialized to a first initialization voltage in response to the first scan signal having a gate-on level, wherein the initialization controller is configured to determine whether to provide the first scan signal having the gate-on level to each of the pixels for each frame, and wherein the initialization controller is implemented as a register in the timing controller.

11. A driving method for driving a display device at a plurality of frequencies, the driving method comprising:

determining a frequency change of a current frame based on a previous frame; and driving the display device in a normal mode or an initialization mode according to a result of the determining of the frequency change, wherein the initialization mode is a mode including a period in the current frame in which an anode of a light emitting element is initialized to an initialization voltage, and wherein the normal mode is a mode that does not include any period in the current frame in which the anode of the light emitting element is initialized.

12. The driving method of claim 11, wherein the display device is driven in the normal mode when there is an increase in frequency of the current frame based on the previous frame, or when a rate of change in an increase of frequency of the current frame is greater than or equal to a reference value.

13. The driving method of claim 11, wherein the determining of the frequency change comprises:

determining whether there is a change in frequency in the current frame based on a frequency of the previous frame, or determining whether a rate of change in frequency between the current frame and the previous frame is greater than or equal to a reference value.

14. The driving method of claim 13, wherein the display device is driven in the initialization mode when there is no change in the frequency of the current frame based on the previous frame, or when the rate of change in frequency is less than the reference value, and wherein the display device is driven in the normal mode when there is a change in the frequency of the current frame based on the previous frame, or when the rate of change in frequency is greater than or equal to the reference value.

15. The driving method of claim 11, wherein the display device comprises:

a pixel comprising the light emitting element;

a scan driver configured to provide a scan signal to the pixel; and a power supply configured to provide the initialization voltage to the pixel, and wherein the initialization voltage is provided to the anode of the light emitting element in response to the scan signal having a gate-on level.

16. The driving method of claim 15, wherein the scan signal does not include the gate-on level in the normal mode, and the scan signal includes the gate-on level in the initialization mode.

17. The driving method of claim 11, further comprising:

determining whether a luminance in the current frame is less than or equal to a reference value.

18. The driving method of claim 17, wherein:

the determining of the frequency change is performed when the luminance is less than or equal to the reference value, and the display device is driven in the initialization mode in the current frame when the luminance is greater than the reference value.

19. The driving method of claim 11, further comprising:

determining whether a grayscale value in the current frame is less than or equal to a reference value.

20. The driving method of claim 19, wherein:

the determining of the frequency change is performed when the grayscale value is less than or equal to the reference value, and the display device is driven in the initialization mode in the current frame when the grayscale value is greater than the reference value.

* * * * *